US008330676B2

(12) United States Patent
Shinohe et al.

(10) Patent No.: US 8,330,676 B2
(45) Date of Patent: Dec. 11, 2012

(54) PLASMA TUBE ARRAY-TYPE DISPLAY DEVICE AND LUMINANCE CORRECTING METHOD

(75) Inventors: Koji Shinohe, Kobe (JP); Koji Kishimoto, Kobe (JP); Tetsuya Makino, Kobe (JP); Hitoshi Hirakawa, Kobe (JP); Kenji Awamoto, Kobe (JP)

(73) Assignee: Shinoda Plasma Co., Ltd., Kobe-Shi (JP)

( * ) Notice: Subject to any disclaimer, the term of this patent is extended or adjusted under 35 U.S.C. 154(b) by 788 days.

(21) Appl. No.: 12/486,028

(22) Filed: Jun. 17, 2009

(65) Prior Publication Data

US 2009/0322656 A1 Dec. 31, 2009

(30) Foreign Application Priority Data

Jun. 26, 2008 (JP) ..... 2008-166982

(51) Int. Cl.
*G09G 3/28* (2006.01)

(52) U.S. Cl. ..... 345/63; 345/60; 345/72; 445/24; 348/572; 348/687

(58) Field of Classification Search ..... 345/60, 345/63, 72
See application file for complete search history.

(56) References Cited

U.S. PATENT DOCUMENTS

| | | | | |
|---|---|---|---|---|
| 6,924,778 | B2 * | 8/2005 | Awamoto et al. | 345/60 |
| 2001/0041489 | A1 * | 11/2001 | Takeuchi et al. | 445/24 |
| 2003/0231148 | A1 * | 12/2003 | Lin et al. | 345/63 |
| 2005/0151883 | A1 * | 7/2005 | Arai et al. | 348/572 |
| 2005/0200571 | A1 * | 9/2005 | Gotoda et al. | 345/63 |
| 2006/0227073 | A1 * | 10/2006 | Okano et al. | 345/60 |
| 2006/0262038 | A1 * | 11/2006 | Lee | 345/63 |
| 2007/0164932 | A1 * | 7/2007 | Moon | 345/63 |
| 2008/0266213 | A1 * | 10/2008 | Kim | 345/63 |

FOREIGN PATENT DOCUMENTS

| | | |
|---|---|---|
| JP | 11-344949 | 12/1999 |
| JP | 2004-86165 | 3/2004 |

* cited by examiner

*Primary Examiner* — Alexander S Beck
*Assistant Examiner* — Amen Bogale
(74) *Attorney, Agent, or Firm* — Staas & Halsey LLP

(57) ABSTRACT

This invention provides a plasma tube array-type display device and a luminance correcting method realizing reduced variations in luminance values of a plasma tube array. A gradient of the luminance value in the longitudinal direction of one plasma tube is calculated on the basis of the obtained luminance value at a plurality of positions in the longitudinal direction of at least one plasma tube. A difference of the luminance value of each plasma tube obtained at the same relative position. On the basis of the gradient of the luminance value and the difference of the luminance value of each plasma tube at the same relative position, a correction luminance value in each discharge cell in the longitudinal direction of each of the plurality of plasma tubes is calculated.

3 Claims, 16 Drawing Sheets

PLASMA TUBE ARRAY-TYPE DISPLAY DEVICE AND LUMINANCE CORRECTING METHOD

CROSS-REFERENCE TO RELATED APPLICATIONS

This application claims priority to and the benefit of Japanese Application Ser. No. 2008-166982 which was filed Jun. 26, 2008, entitled Display Device and Computer Program, the entirety of being hereby incorporated by reference as if fully set forth herein.

BACKGROUND OF THE INVENTION

1. Field of the Invention

The present invention relates to a plasma tube array-type display device joining a plurality of plasma tube array-type display sub-modules to each other comprising a plasma tube array in which a plurality of plasma tubes is arranged in parallel, and a luminance correcting method. More particularly, the present invention relates to a plasma tube array-type display device and a luminance correcting method capable of reducing variations in luminance values of a plasma tube array.

2. Description of the Related Art

As a technology for realizing a next-generation large-screen display device, a plasma tube array-type display sub-module has been developed with a structure that a plurality of plasma tubes each filled with a discharge gas is arranged in parallel. For example, a large-screen display device having a scale of several meters by several meters in size can be constructed of a plasma tube array-type display system module that a plurality of plasma tube array-type display sub-modules of one square-meter in size is joined to one another. The display device of this type does not need either a large glass substrate to be handled, like an LCD, a PDP and the like, nor a large-scale facility and achieves even image quality at low cost.

Typically, a large-screen plasma tube array-type display device can be constructed as follows. That is, a plasma tube array-type display sub-module is prepared in such a manner that a plasma tube array is integrated with a structural body called a sub-module frame of a certain size. Then, the plurality of plasma tube array-type display sub-modules is joined to one another. Herein, the "plasma tube array-type display sub-module" refers to a display film component as described above which includes a plasma tube, that is, a semi-finished product of a display panel which does not have a drive circuit, a power supply circuit and the like incorporated. FIGS. 1A and 1B are perspective views schematically showing a configuration of a plasma tube array of a conventional plasma tube array-type display sub-module. FIG. 1A is a perspective view schematically showing a configuration of a plasma tube array of a plasma tube array-type display sub-module, and FIG. 1B is a perspective view partly showing the configuration of the plasma tube array of the plasma tube array-type display sub-module.

As shown in FIG. 1A, the conventional plasma tube array-type display sub-module has a rectangular shape as it comprises a part of a rectangular screen and a plurality of plasma tubes 131, 131, . . . each filled with a discharge gas is arranged in parallel. The plasma tube array-type display sub-module is constructed in such a manner that the plurality of plasma tubes 131, 131, . . . arranged in parallel is held between an address electrode sheet 133 with a plurality of address electrodes 132, 132, . . . formed thereon along the longitudinal direction of the plasma tubes 131, 131, . . . and a display electrode sheet 135 with a plurality of display electrode pairs 134, 134, . . . formed thereon substantially orthogonal to the longitudinal direction of the plasma tubes 131, 131, . . . .

The plurality of display electrode pairs 134, 134, . . . are formed in stripes on the display side of the plasma tube array-type display sub-module orthogonal to the longitudinal direction of the plasma tubes 131, 131, . . . . Herein, the display electrode pair 134 is not particularly limited as long as display discharge can occur inside the plurality of plasma tubes 131, 131, . . . located between the adjacent display electrode pairs 134, 134. The address electrodes 132, 132, . . . are formed on the back side of the plasma tube array-type display sub-module for each plasma tube 131 along the longitudinal direction of the plasma tubes 131, 131, . . . . Herein, the address electrode 132 is not particularly limited as long as an emit light cell is formed at an intersection of the address electrode 132 and the display electrode pair 134, 134.

As described above, as shown in FIG. 1B, the plasma tube array-type display sub-module achieves color display in such a manner that each plasma tube 131 comprises a single-color phosphor layer 136. Examples of the phosphor layer 136 comprise a red (R) phosphor layer 136R, a green (G) phosphor layer 136G and a blue (B) phosphor layer 136B. A set of the plasma tube 131 comprising the R phosphor layer 136R, the plasma tube 131 comprising the G phosphor layer 136G and the plasma layer 131 comprising the B phosphor layer 136B forms one pixel, so that the plasma tube array-type display sub-module can achieve color display.

Because of the structure of the plasma tube 131, it is difficult to manufacture the plasma tubes 131, 131, . . . for each color so that the luminance of all of the plurality of plasma tubes 131, 131, . . . is completely even. When all of structural elements such as shape and thickness of glass tubes, as well as the shape, thickness, and the like of the phosphor layers are made even, the luminance is even. However, it is unrealistic to manufacture the plasma tubes without any error in the elements as the cost increases because of a decrease in conforming item ratio, an increase in manufacturing steps, and the like. In the case of configuring as a plasma tube array-type display sub-module, luminance differences occur in each plasma tube 131 of the same color, for example, for red (R), and it causes variations in luminance in the direction where the plasma tubes 131, 131, . . . are arranged in parallel. Due to occurrence of the luminance differences in each plasma tube 131 of the same color, the color balance varies among pixels each constructed by a set of plasma tubes 131, 131, 131 for three colors of R, G, B, and it is perceived as variations in colors (color unevenness) in the direction in which the plurality of plasma tubes 131, 131, . . . is arranged in parallel.

In the longitudinal direction of the plasma tubes 131, 131, . . . the luminance difference between the adjacent emit light cells is small. For example, the gradient of a luminance value which gradually increases is shown. Here, "luminance value" means the brightness level of each discharge cell when the same driving voltage is applied between the display electrodes forming a plurality of discharge cells. The reason is considered that, in the process of manufacturing the plasma tube 131, since the plasma tube 131 is particularly long, at the time of being evacuated and filled with a gas, the state (cleanness or the like) of the internal discharge surface of the plasma tube 131 varies according to the distance from the evacuating port. Therefore, comparing to the longitudinal direction of the plasma tubes 131, 131, . . . , in the parallel direction in which the plurality of plasma tubes 131, 131, . . . is arranged in parallel, the luminance difference between the adjacent emit light cells is larger, and the gradient of the luminance value indicative shows a sharp luminance change. There is, consequently, a problem such that the luminance variations are more easily perceived in the parallel direction.

To correct variations in light emission luminance of a display element, for example, in JP 11-344949 A, correction data for correcting variations in the light emission luminance of each display element is stored in a memory device and, at the time of driving the display element, the correction data is supplied to the corresponding driver. In a state where variations in the light emission luminance are corrected, display can be driven.

For example, in JP 2004-86165 A, a uniform image is displayed on a display device, luminance of each display element is detected, and a luminance target value of each display elements is calculated. On the basis of the luminance target value of each display element, a luminance correction coefficient on each display element is calculated. In such a manner, in the case of configuring a large-screen display device by arranging a number of display units, variations in luminance values of each display unit and joining portions are inconspicuous, and the image quality is improved.

In both of JP 11-344949 A and JP 2004-86165 A, however, luminance data of all the display elements is detected and, on the basis of each luminance data, correction data for correcting luminance of each display element is provided for each display element. Therefore, particularly for a high-definition image or the like, it is necessary to store a considerable amount of correction data and perform process with the correction data. The high-definition image is displayed by 1920×1080=2073600 pixels. In the case where each pixel has, for example, 64 levels of luminance difference information, the total pixels of the three colors of R, G, B is 2073600×3 (sub-pixels)×6 (bits) (64 levels)=37324800 (bits)=4665600 (bytes), that is an information amount of about 4.6 Mbytes. In the case of 60 Hz television frame, the information amount of about 280 Mbytes has to be processed per second, which is calculated by 4665600 (bytes)×60 (Hz)=279936000 (bytes), and for which large-amount memory and a high-speed computing circuit are required.

SUMMARY OF THE INVENTION

The present invention has been achieved in consideration of such circumstances and an object of the present invention is to provide a plasma tube array-type display device and a luminance correcting method capable of reducing variations in luminance values of a plasma tube array without requiring a large memory and a high-speed computing circuit.

In order to achieve the object, a first aspect of the present invention is directed to a plasma tube array-type display device comprising a plurality of plasma tubes independent of one another and filled with a discharge gas, an address electrode along the longitudinal direction of each plasma tube, and a plurality of display electrode pairs extending in the direction crossing all of the plasma tubes so as to form display lines of discharge cells in intersecting portions with the address electrodes, wherein the plasma tube array-type display device comprises a first memory for storing a first coefficient representing a gradient of a luminance value along the longitudinal direction of at least one of the plurality of plasma tubes, a second memory for storing second coefficients representing a difference of a luminance value of each of the discharge cells at the same relative position in the longitudinal direction of the plurality of plasma tubes, and a controller for calculating a correction coefficient for the luminance value at each discharge cell in the longitudinal direction of each of the plurality of plasma tubes on the basis of the first coefficient and the second coefficients.

In the plasma tube array-type display device, the plurality of plasma tubes arranged in parallel and configuring the plasma tube array, has a constant gradient of a luminance value in the longitudinal direction of the plasma tubes, and the luminance value can be approximated by straight lines having almost the same gradient to the relative position in the longitudinal direction of the plasma tube. Accordingly, by using the first coefficient representing the gradient of the luminance value of at least one of the plurality of plasma tubes configuring the plasma tube array and the second coefficient representing the difference of the luminance value among the discharge cells at the same relative position of all of the plasma tubes configuring the plasma tube array, the correction coefficients in luminance value of all of the discharge cells arranged in matrix form can be calculated and variations in a brightness of each of the plasma tube array can be compensated. Therefore, without requiring the large memory and a high-speed computing circuit, the luminance of image data of all of cells of the display device can be corrected.

Next, in order to achieve the object, a second aspect of the present invention is directed to a plasma tube array-type display device comprising a plurality of plasma tubes independent of one another and filled with a discharge gas, an address electrode along the longitudinal direction of each plasma tube, and a plurality of display electrode pairs extending in the direction crossing all of the plasma tubes so as to form display lines of discharge cells in intersecting portions with the address electrodes, wherein the plasma tube array-type display device comprises a luminance value obtaining portion for obtaining luminance values at a plurality of positions in the longitudinal direction of at least one of the plurality of plasma tubes and the luminance value at the same relative position in the longitudinal direction of the plurality of plasma tubes, a gradient of the luminance value calculating portion for calculating the gradient of the luminance value in the longitudinal direction of the one plasma tube on the basis of the obtained luminance value at the plurality of positions in the longitudinal direction of the one plasma tube, a plasma tube selecting portion for selecting a plasma tube with a luminance value, a predetermined value higher than that of an adjacent plasma tube of the same color at the same relative position, a subtraction information calculating portion for calculating subtraction information for subtracting a luminance value from each of the selected plasma tubes at a predetermined ratio on the basis of the luminance value of the selected plasma tube and the luminance value of the plasma tube of the same color arranged within a predetermined range from the selected plasma tube, a luminance information storing portion for storing the luminance value at the same relative position, the subtraction information, and the calculated gradient of the luminance value of each selected plasma tube, and a correction portion for calculating a correction luminance value at each position in the longitudinal direction of each of the selected plasma tubes on the basis of the gradient of the luminance value stored, the luminance values in the same relative position, and the subtraction information.

According to the second aspect of the present invention, luminance value at the plurality of positions in the longitudinal direction of at least one of the plurality of plasma tubes and luminance value at the same relative position in the longitudinal direction of the plurality of plasma tubes are obtained, and the gradient of the luminance value in the longitudinal direction of the one plasma tube on the basis of the obtained luminance value at the plurality of positions in the longitudinal direction of the one plasma tube are calculated. A plasma tube with the luminance value, a predetermined value higher than that of the adjacent plasma tube of the same color at the same relative position is selected, and the subtraction information for subtracting the luminance value from each of the selected plasma tubes at a predetermined ratio is calculated on the basis of the luminance value of the selected plasma tube and the luminance value of the plasma tube of the same color arranged within a predetermined range from the selected plasma tube. The luminance values at the same relative position, the subtraction information, and the calculated gradient of the luminance value of each selected plasma tube are stored, and the correction luminance value at each position in the longitudinal direction of each of the selected plasma tubes is calculated on the basis of the gradient of the luminance value, the luminance value at the same relative position, and the subtraction information stored. Even if the luminance difference is the same, due to so-called mach effect, it is easily visually recognized that the luminance difference of one plasma tube with a plasma tube in shorter distance is larger than that with a plasma tube in longer distance in a far position. Therefore, by correcting only the luminance value of the plasma tube existing in the position where the luminance difference is easily recognized largely, the memory amount required for correction can be reduced, and the variation difference with a plasma tube existing in a position where the influence is large can be effectively reduced.

A third aspect of the present invention is directed to the plasma tube array-type display device according to the first or second aspect of the present invention, wherein the plurality of plasma tubes comprises plasma tubes for three colors of red, green, and blue, and the first memory stores the three kinds of first coefficients respectively representing the gradient of the luminance value of at least one plasma tube for each color.

According to the third aspect of the present invention, the plurality of plasma tubes comprises plasma tubes for three colors of red, green, and blue, and the first memory stores the three kinds of first coefficients respectively representing the gradient of the luminance value of at least one plasma tube for each color Consequently, the gradient of the luminance value of all of the plasma tubes can be grasped by using the gradient of the luminance value of at least one plasma tube for each of the colors and the luminance value in the same relative position in all of the plasma tubes configuring the plasma tube array. Variations in luminance values of the plasma tube array can be reduced.

A fourth aspect of the present invention is directed to the plasma tube array-type display device according to the first or second aspect of the present invention, wherein the plurality of plasma tubes comprises plasma tubes for three colors of red, green, and blue, and the first memory stores the first coefficient representing the gradient of the luminance value of at least one plasma tube for green.

According to the fourth aspect of the present invention, the plurality of plasma tubes comprises plasma tubes for three colors of red, green, and blue, and the first memory stores the first coefficient representing the gradient of the luminance value of at least one plasma tube for green. By correcting the luminance value of the plasma tube for green only whose luminance difference are easy to be recognized visually, the memory amount required for correction can be reduced, and the luminance difference of the plasma tube for green under a profound influence can be effectively reduced.

A fifth aspect of the present invention is directed to a luminance correcting method for a plasma tube array-type display device which comprises a plurality of plasma tubes independent of one another and filled with a discharge gas, an address electrode along the longitudinal direction of each plasma tube, and a plurality of display electrode pairs extending in the direction crossing all of the plasma tubes so as to form display lines of discharge cells in intersecting portions with the address electrode, wherein the luminance correcting method comprises the steps of preliminarily measuring a first coefficient indicative of a gradient of a luminance characteristic along the longitudinal direction of at least one plasma tube and a second coefficient indicative of the difference of the luminance characteristic between discharge cells on the display lines along at least a pair of display electrodes of the plasma tubes, computing a luminance correction coefficient according to a position of each discharge cell on the basis of the first and second coefficients, and correcting a brightness data to be displayed by the computed luminance correction coefficient.

According to the fifth aspect of the present invention, the first coefficient indicative of the gradient of the luminance characteristic along the longitudinal direction of at least one plasma tube and the second coefficient indicative of the difference of luminance characteristics between discharge cells on the display lines along at least a pair of display electrodes of all of the plasma tubes are measured in advance. On the basis of the first and second coefficients measured in advance, the luminance correction coefficient depending on the position of each display cell is computed, and luminance data to be displayed is corrected by the computed luminance correction coefficient. The gradient of the luminance value in the longitudinal direction of the plurality of plasma tubes configuring the plasma tube array is constant. By measuring the first coefficient indicative of the gradient of the luminance characteristic along the longitudinal direction of the plasma tubes and the second coefficient indicative of the difference in luminance characteristic of discharge cells on the display lines along at least one pair of display electrodes in all of the plasma tubes, the gradient of the luminance value of all of the plasma tubes can be grasped, and variations in luminance values of the plasma tube array can be reduced. Therefore, without requiring a large memory and a high-speed computing circuit, using the gradient of the luminance value of at least one plasma tube and the luminance value at the same relative position of all of the plasma tubes only, the luminance of image data of all of pixels of the display device can be corrected.

A sixth aspect of the present invention is directed to the luminance correcting method according to the fifth aspect of the present invention, wherein the plasma tube array-type display device comprises a configuration in which plasma tubes having phosphors of red, green, and blue therein are arranged cyclically, and the luminance correcting method comprises the step of preliminarily measuring the first and second coefficients for each group of plasma tubes for different colors.

According to the sixth aspect of the present invention, the plasma tube array has a configuration in which the plasma tubes having therein phosphors of red, green, and blue are arranged cyclically, and the first and second coefficients are measured in advance for each group of plasma tubes for different colors. Consequently, by measuring the first and second coefficients for each of the groups of R, G, and B, the gradient of the luminance value of plasma tubes belonging to each of the groups can be grasped, and variations in luminance values of the plasma tube array can be reduced. Therefore, without requiring a large memory and a high-speed computing circuit, using the gradient of the luminance value of at least one plasma tube and the luminance value at the same relative position of all of the plasma tubes only, the luminance of image data of all of pixels of the display device can be corrected.

A seventh aspect of the present invention is directed to the luminance correcting method according to the sixth aspect of the present invention, wherein in the case where the first coefficient indicative of the gradient of the luminance value along the longitudinal direction of at least one plasma tube is constant, the second coefficient indicative of the difference in the luminance characteristic is determined on the basis of the luminance value preliminarily measured in each discharge cell on one display line at an almost intermediate position in the longitudinal direction of all of the plasma tubes.

According to the seventh aspect of the present invention, in the case where the first coefficient indicative of the gradient of the luminance value along the longitudinal direction of at least one plasma tube is constant, the second coefficient indicative of the difference in luminance characteristic is determined on the basis of the luminance value preliminarily measured in each discharge cell on one display line at almost the intermediate position in the longitudinal direction of all of the plasma tubes. Even in the case where the gradient of the luminance value at the relative positions in the longitudinal direction of the plurality of plasma tubes arranged in parallel and configuring the plasma tube array is constant, due to slight differences in the gradient among the plasma tubes, the luminance difference varies among the plurality of plasma tubes depending on the positions in the longitudinal direction of the plasma tubes. That is, near both ends in the longitudinal direction of the plurality of plasma tubes, the luminance difference is smaller or larger than that at the intermediate position. Therefore, by obtaining the luminance value at almost the intermediate position in the longitudinal direction of the plurality of plasma tubes where the luminance has an average value as the luminance value representing each plasma tube, also in the case where the plurality of plasma tubes have the gradient of the luminance value indicated by straight lines having slightly different gradients, deviations in correction at both ends of the plasma tubes are suppressed and the luminance can be properly corrected.

An eighth aspect of the present invention is directed to the luminance correcting method according to the sixth aspect of the present invention, wherein in the case where the first coefficient indicative of the gradient of the luminance value along the longitudinal direction of at least one plasma tube has a plurality of first coefficient value in a predetermined range divided by a predetermined position, as a border, in the longitudinal direction of the one plasma tube, the second coefficient indicative of the difference in the luminance characteristic is determined on the basis of the luminance value preliminarily measured in each discharge cell on one display line selected in each range with different gradient of the first coefficient value.

According to the eighth aspect of the present invention, in the case where the first coefficient indicative of the gradient of the luminance value along the longitudinal direction of at least one plasma tube has the plurality of first coefficient value in a predetermined range divided by a predetermined position, as a border, in the longitudinal direction of the one plasma tube, the second coefficient indicative of the difference in the luminance characteristic is determined on the basis of the luminance value preliminarily measured in each discharge cell on one display line selected in each range with different gradient of the first coefficient value. There is a case that the plurality of plasma tubes arranged in parallel have the gradient of the luminance value indicated by first straight lines having almost the same gradient from one end in the longitudinal direction of the plasma tubes to a predetermined relative position, and have the gradient of the luminance value indicated by second straight lines having almost the same gradient which is different from that of the first straight lines from the predetermined relative position to the other end. Therefore, in a case where the gradient of a predetermined range divided by the predetermined position, as the border, in the longitudinal direction of the plurality of plasma tubes arranged in parallel and configuring the plasma tube array, by obtaining the luminance value at the same relative position in the longitudinal direction of the plurality of plasma tubes by each of the varied gradient, proper correction can be performed in accordance with variations in gradients.

As described above, in the plurality of plasma tubes arranged in parallel and configuring the plasma tube array, the gradient of the luminance value in the longitudinal direction of the plasma tube is constant, and the luminance value can be approximated to a relative position in the longitudinal direction of the plasma tubes with straight lines having almost the same gradient. By using the gradient of the luminance value of at least one of the plurality of plasma tubes configuring the plasma tube array and the luminance value at the same relative position of all of the plasma tubes configuring the plasma tube array, the gradient of the luminance value of all of the plasma tubes can be grasped, and variations in luminance values of the plasma tube array can be reduced. Therefore, without requiring a large memory and a high-speed computing circuit, using the gradient of the luminance value of at least one plasma tube and the luminance value at the same relative position of all of the plasma tubes only, the luminance of image data of all of the pixels in the display device can be corrected.

DESCRIPTION OF THE PREFERRED EMBODIMENTS

A plasma tube array-type display device according to embodiments of the present invention will be described in detail below with reference to the drawings.

First Embodiment

Figure 1B:
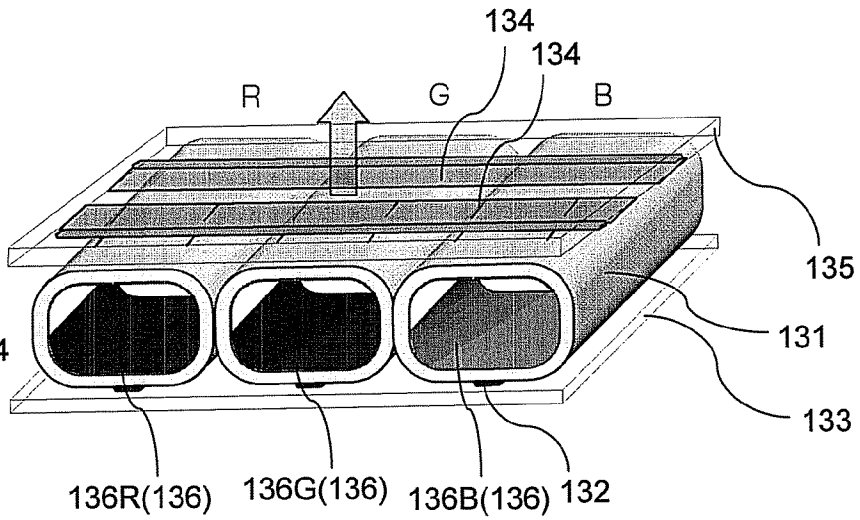
FIGS. 1A and 1B are perspective views schematically showing a configuration of a plasma tube array of a conventional plasma tube array-type display sub-module.
Figure 1A:
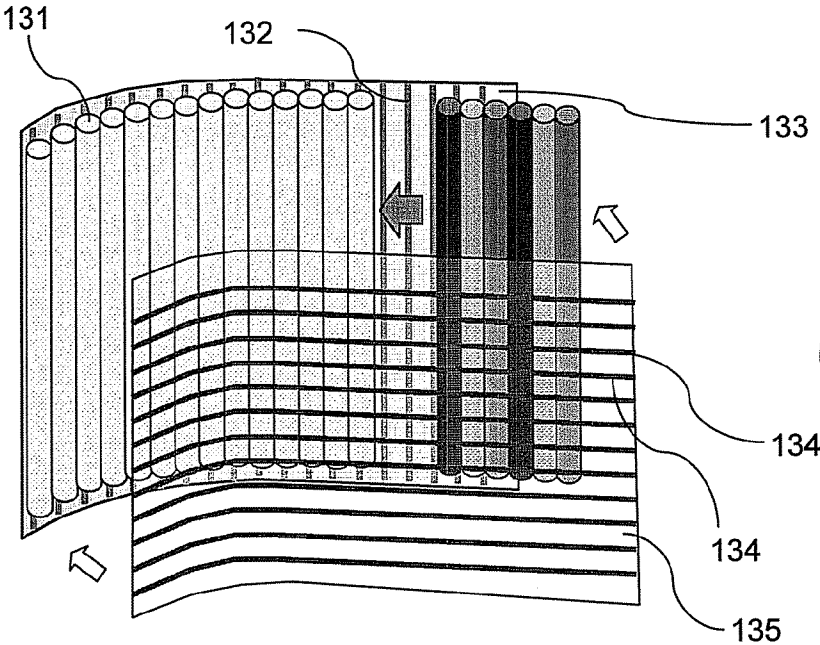
Figure 2:
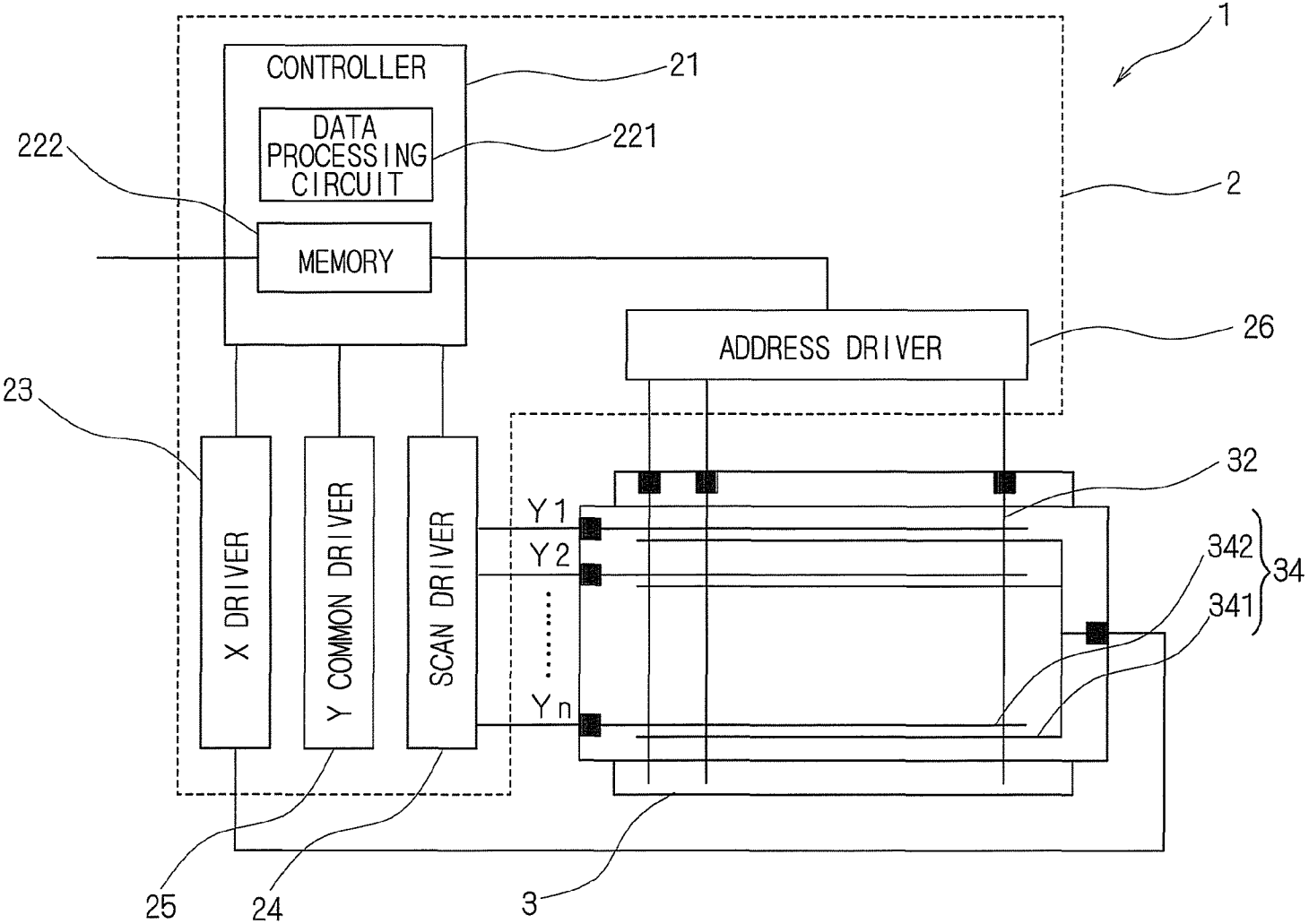
FIG. 2 is a schematic diagram showing the configuration of a plasma tube array-type display device according to a first embodiment of the present invention.

FIG. 2 is a schematic diagram showing the configuration of a plasma tube array-type display device according to the first embodiment of the present invention. As shown in FIG. 2, a plasma tube array-type display device 1 according to the first embodiment comprises a drive unit 2 and a plasma tube array-type display system module 3 joining a plurality of plasma tube array-type display sub-modules vertically and horizontally to one another. The drive unit 2 comprises, at least, a controller 21, an X driver 23, a scan driver 24, a Y common driver 25, and an address driver 26. To the drive unit 2, image data comprising field data in pixel unit indicative of luminance level (gray level) is input with various synchronized signals from external devices such as a TV tuner and a computer.

The plasma tube array-type display system module 3 is joined to the drive unit 2. A plurality of display electrodes 34, 34, . . . extends in the row direction of a display screen, each display electrode 34 is configured by a pair of a sustain X electrode 341 and a scan/sustain Y electrode 342, and an emit light cell is formed in an intersecting region of the display electrode 34 and an address electrode 32. At the time of selecting a cell to be emitted by discharge between the display electrode pairs 34, 34 in each emit light cell, the scan/sustain Y electrode 342 is used as a scan electrode for selecting cells on the row unit basis. The address electrode 32 extends in the column direction and is used as an electrode for selecting cells in the column unit basis.

The controller 21 has a data processing circuit 221 and a memory 222, controls the above-described various drivers, and controls luminance value correcting process in the data processing circuit 221 based on field data and correction information stored in the memory 222. The functional configuration of the controller 21 will be described later.

Figure 3C:
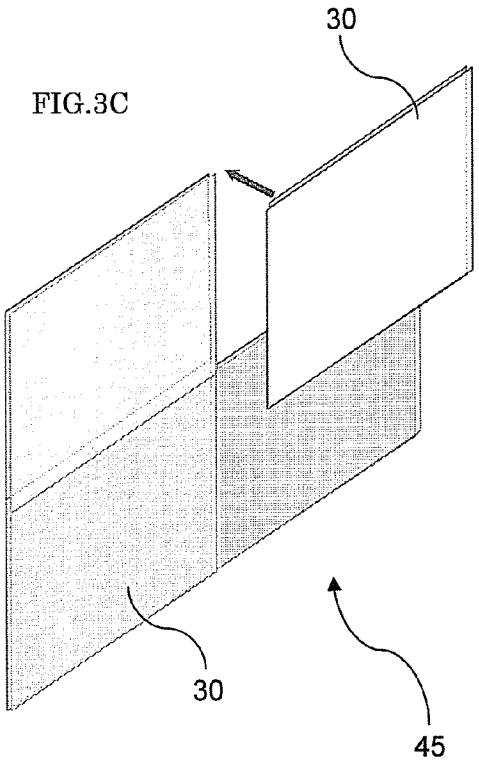
FIGS. 3A to 3C are perspective views schematically showing a configuration of a plasma tube array of a plasma tube array-type display sub-module configuring a plasma tube array-type display system module of the plasma tube array-type display device according to the first embodiment of the present invention.
Figure 3A:
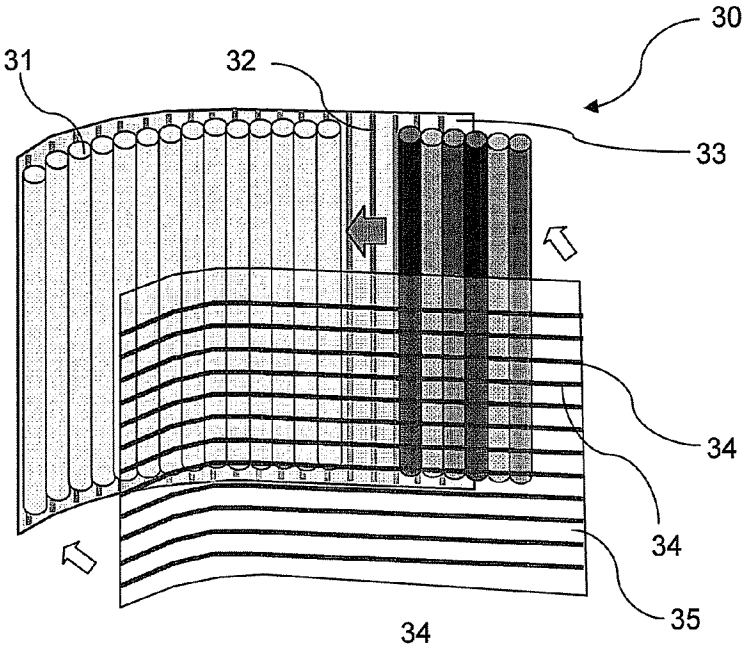
Figure 3B:
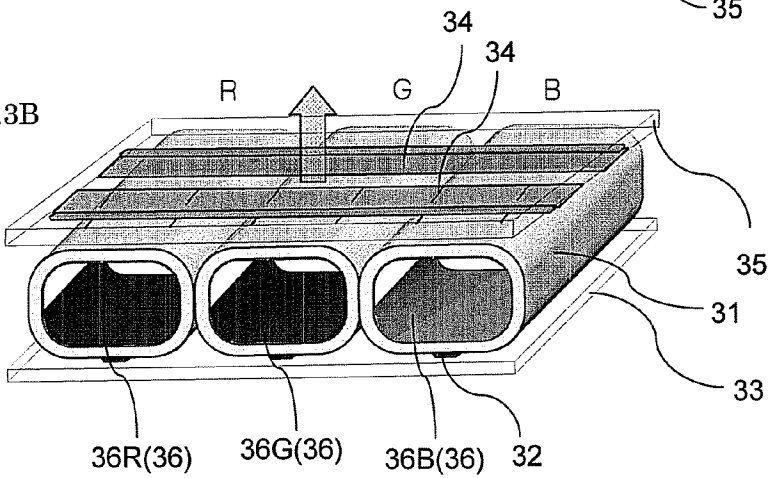

FIGS. 3A to 3C are perspective views schematically showing a configuration of a plasma tube array of the plasma tube array-type display sub-module configuring the plasma tube array-type display system module 3 of the plasma tube array-type display device 1 according to the first embodiment of the present invention. More specifically, FIG. 3A is a perspective view schematically showing the configuration of the plasma tube array of the plasma tube array-type display sub-module. FIG. 3B is a perspective view partly showing the configuration of the plasma tube array of the plasma tube array-type display sub-module. FIG. 3C is a perspective view showing a state that the plasma tube array-type display sub-modules are joined vertically and horizontally to one another.

As shown in FIG. 3A, a plasma tube array-type display sub-module 30 has a rectangular shape as it comprises a part of a rectangular screen and a plurality of plasma tubes 31, 31, . . . each filled with a discharge gas is arranged in parallel. The plasma tube 31 is a discharging thin tube made of glass, which diameter is not particularly limited, but preferably about 0.5 to 5 mm. Herein, for example, the plasma tube array-type display sub-module 30 of one square-meter in size is constructed in such a manner that 1000 pieces of glass thin tubes each having a diameter of 1 mm, a length of 1 m and an oblate ellipsoid section are arranged in parallel by a set of several pieces. The section of the thin tube is not particularly limited in shape, and examples thereof may include a circular section, an oblate ellipsoid section, a square section and the like. Moreover, the plasma tube 31 is filled with a discharge gas such as neon, xenon and the like at a predetermined ratio at a predetermined pressure.

The plurality of plasma tubes 31, 31, . . . arranged in parallel is held between a back-side address electrode sheet 33, which comprises a plurality of address electrodes 32, 32, . . . formed thereon so as to be in contact with the lower side of the plasma tubes 31, 31, . . . in the longitudinal direction of the plasma tubes 31, 31, . . . , and a front-side display electrode sheet 35, which comprises the plurality of display electrodes 34, 34, . . . formed thereon so as to cross the upper side of the plasma tubes 31, 31, . . . orthogonal to the longitudinal direction of the plasma tubes 31, 31, . . . . Herein, the display electrode sheet 35 is a flexible sheet made of, for example, a polycarbonate film, a PET (polyethylene terephthalate) film or the like.

The plurality of display electrodes 34, 34, . . . is formed in stripes on the inner surface of the display electrode sheet 35 so as to be in contact with the plasma tubes 31, 31, . . . in the direction crossing the upper side of the plasma tubes 31, 31, . . . . The adjacent display electrodes 34, 34 forming a display electrode pair function as an X electrode and a Y electrode. Display discharge occurs inside the plasma tubes 31, 31, . . . located between the X electrode and the Y electrode. In addition to the stripe pattern, the pattern of the display electrodes 34, 34, . . . may be a pattern which is publicly known in the relevant technical field, and examples thereof may include a mesh pattern, a ladder pattern, a comb pattern and the like. Moreover, examples of the material for the display electrode 34 may include transparent conductive materials such as ITO (Indium Tin Oxide) and $SnO_2$, and metal conductive materials such as Ag, Au, Al, Cu and Cr and the like.

The display electrode 34 can be formed by various methods which are publicly known in the relevant technical field. For example, the display electrode 34 may be formed by using a thick film technology, such as a printing, or by using a thin film technology such as a physical deposition method or a chemical deposition method. Examples of the thick film technology may include a screen print method and the like. With regard to the thin film technology, examples of the physical deposition method may include an evaporation method, a sputtering method and the like whereas examples of the chemical deposition method may include a thermal CVD method, a photo CVD method, a plasma CVD method and the like.

The address electrodes 32, 32, . . . are formed on the back side of the plasma tube array-type display sub-module 30 per plasma tube 31 along the longitudinal direction of the plasma tubes 31, 31, . . . , wherein the emit light cell is formed at an intersection of the address electrode 32 and the paired display electrode 34. The address electrode 32 can be formed by various materials and methods which are publicly known in the relevant technical field.

In the configuration described above, as shown in FIG. 3B, the plasma tube array-type display sub-module 30 achieves color display in such a manner that each plasma tube 31 comprises a single-color phosphor layer 36. Examples of the phosphor layer 36, 36, . . . comprise a red (R) phosphor layer 36R, a green (G) phosphor layer 36G and a blue (B) phosphor layer 36B. A set of the plasma tube 31 comprising the red (R) phosphor layer 36R, the plasma tube 31 comprising the green (G) phosphor layer 36G and the plasma tube 31 comprising the blue (B) phosphor layer 36B forms one pixel, so that the plasma tube array-type display sub-module 30 can achieve color display. Herein, the red (R) phosphor layer 36R is made of a phosphor material such as $(Y,Gd)BO_3:EU^{3+}$ in order to emit red light by irradiation with ultraviolet rays. The green (G) phosphor layer 36G is made of a phosphor material such as $Zn_2SiO_4$:Mn in order to emit green light by irradiation with ultraviolet rays. The blue (B) phosphor layer 36B is made of a phosphor material such as $BaMgAl_{12}O_{17}:Eu^{2+}$ in order to emit blue light by irradiation with ultraviolet rays. In order to enhance flexibility of the plasma tube array-type display sub-module 30 and facilitate the assembly thereof, preferably, a plasma tube unit is prepared in such a manner that the plurality of the set of the three plasma tubes for three colors R, G, B is attached to the reed-shaped back-side address electrode sheet 33 in parallel, and then the plurality of plasma tube units is attached to the front-side display electrode sheet 35, so that the plasma tube array-type display sub-module 30 for a color display is fabricated.

The perspective view in FIG. 3C schematically shows a plasma tube array-type display system module 45 that the plurality of plasma tube array-type display sub-modules 30, 30, . . . is joined vertically and horizontally to one another. As shown in FIG. 3C, herein, four pieces of plasma tube array-type display sub-modules 30, 30, . . . construct one plasma tube array-type display system module 45 for a large screen. Each plasma tube array-type display sub-module 30 is a semi-finished product which does not have a drive circuit, a power supply circuit and the like incorporated. After construction of the large-screen plasma tube array-type display system module 45, a drive circuit, a power supply circuit and the like are incorporated in the plasma tube array-type display system module 45 defining the whole system module as one display film. Thus, a large-screen display device can be constructed, which has a feature suppressing a variation in quality of images displayed on the respective plasma tube array-type display sub-modules 30, 30, . . . . The plasma tube array-type display sub-modules 30, 30 joined horizontally to each other can be driven simultaneously by connecting the display electrodes 34, 34 in the connection structure according to the present invention. For the plasma tube array-type display sub-modules 30, 30 joined vertically to each other, the respective address electrodes 32, 32 are lead to the upper side and the lower side of the screen so as to be connected to an address drive circuit, whereby the screens of the upper two plasma tube array-type display sub-modules 30, 30 and the screens of the lower two plasma tube array-type display sub-modules 30, 30 can be simultaneously driven by a publicly known method, so-called dual scan technique without connecting the respective address electrodes 32, 32.

Figure 4:
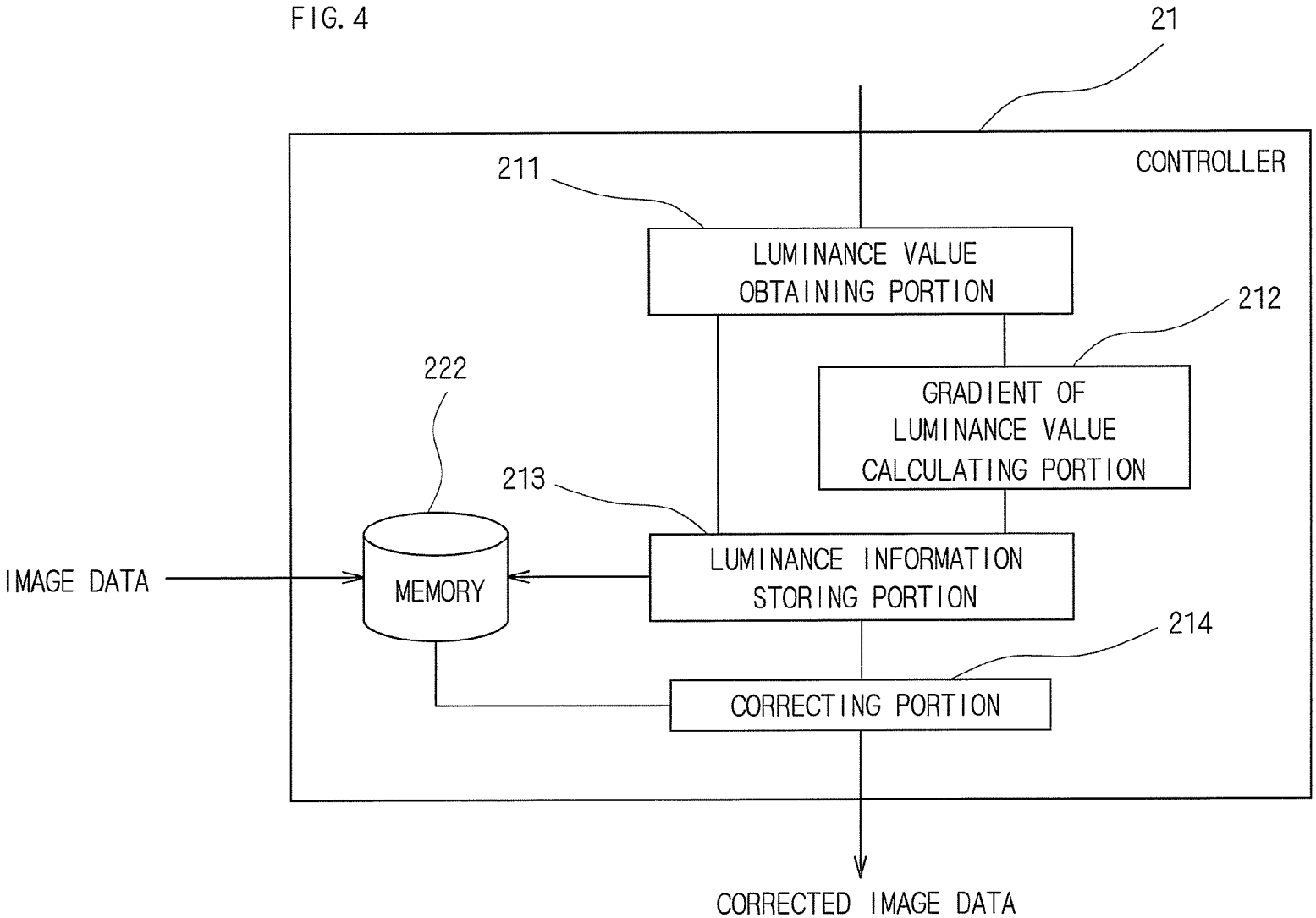
FIG. 4 is a block diagram showing a functional configuration of a controller.

FIG. 4 is a block diagram showing a functional configuration of the controller 21. As shown in FIG. 4, the controller 21 has: luminance value obtaining portion 211 for obtaining the luminance value at a plurality of positions in the longitudinal direction of at least one of the plurality of plasma tubes 31, 31, . . . arranged in parallel and configuring the plasma tube array and the luminance value at the same relative position in the longitudinal direction of the plurality of plasma tubes 31, 31, . . . ; a gradient of luminance value calculating portion 212 for calculating, on the basis of the luminance value at the plurality of position in the longitudinal direction of the plasma tubes 31, 31, . . . obtained with respect to at least one plasma tube 31, the gradient of the luminance value in the longitudinal direction of the plasma tubes 31, 31, . . . ; luminance information storing portion 213 for storing the obtained luminance value at the same relative position of each plasma tube 31 and the calculated gradient of the luminance value in the memory 222; and correcting portion 214 for calculating correction luminance value at each position (relative position) in the longitudinal direction of the plurality of plasma tubes 31, 31, . . . on the basis of the gradient of the luminance value and the luminance value at the same relative position of each plasma tube 31, stored in the memory 222. The functions of the gradient of luminance value calculating portion 212 and the correcting portion 214 are assumed by the data processing circuit 221 of the hardware configuration.

As described above, the plasma tube 31 is a thin tube of a diameter about 0.5 to 5 mm, each filled and sealed with a discharge gas at both ends. Therefore, from the viewpoint of the structure of the plasma tube 31, it is difficult to manufacture the plurality of plasma tubes 31, 31, . . . so that the luminance value of the plasma tubes 31, 31, . . . maintain even.

Figure 5A:
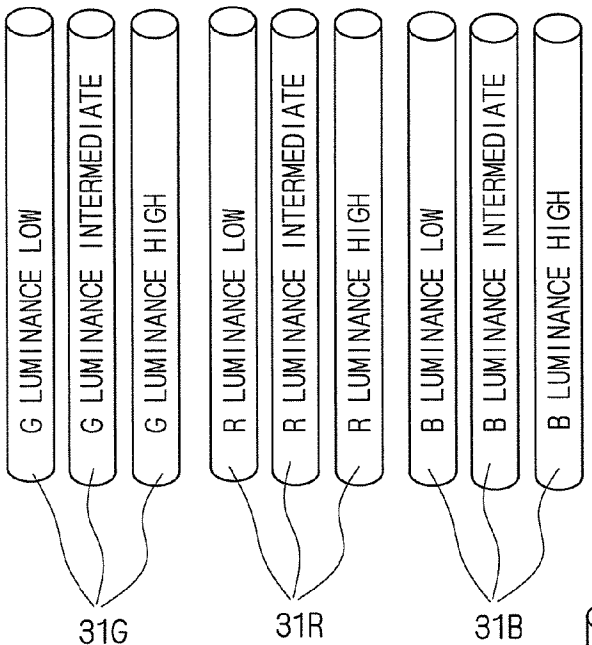
FIGS. 5A to 5C are diagrams schematically showing a state where a luminance value of plasma tubes is different from one another.
Figure 5C:
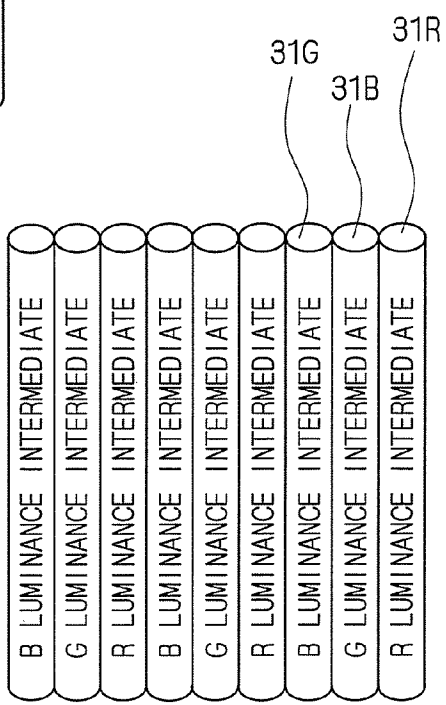
Figure 5B:
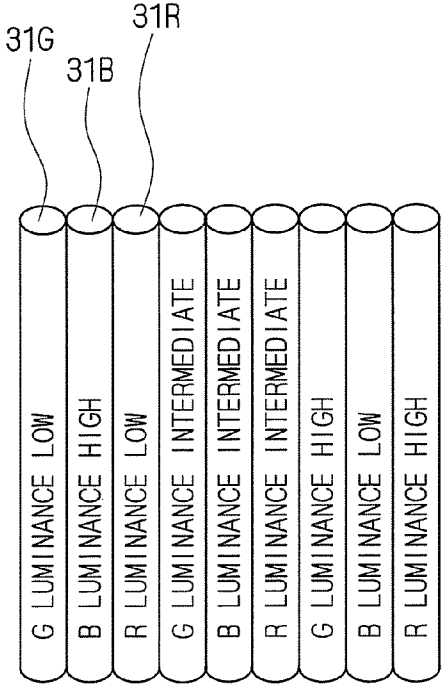

FIGS. 5A to 5C are diagrams schematically showing a state where the luminance value of the plasma tubes 31, 31, . . . is different from one another. FIG. 5A shows a state where the luminance value of the plurality of plasma tubes 31, 31, . . . for R, G, B colors is different from one another. FIG. 5B shows the plasma tube array in which the plurality of plasma tubes 31, 31, . . . of different luminance value by colors is arranged in parallel in order of the colors. FIG. 5C shows a state where the luminance values of the plasma tube array of FIG. 5B have been corrected. As shown in FIG. 5A, the plurality of plasma tubes 31, 31, . . . is manufactured in various luminance value like the plasma tube 31 of a high luminance value, the plasma tube 31 of a low luminance value, and the plasma tube 31 of an intermediate luminance value by colors.

As shown in FIG. 5B, since the plasma tube array is constructed by the plurality of plasma tubes 31, 31, . . . manufactured to have various luminance value as shown in FIG. 5A, when the plasma tubes are arranged in parallel in the order of each color, luminance difference occur among positions in which the plasma tubes 31, 31, . . . are arranged in parallel by colors, and the luminance of the plasma tube array in the parallel direction in which the plasma tubes 31, 31, . . . are arranged in parallel varies. Due to occurrence of the luminance difference among the positions by colors, color balance varies among pixels each configured by the plasma tubes 31, 31, 31 for three colors of R, G, B, defined as a unit, so that the plurality of plasma tubes 31, 31, . . . are visually recognized as variations in colors in the parallel direction. Even in the plasma tube array with variations in luminance values as shown in FIG. 5B, by correcting the luminance value of the plasma tubes 31, 31, . . . so as to be approximated to a predetermined luminance value, the variations in luminance values of the plasma tube array are reduced as shown in FIG. 5C.

Figure 6B:
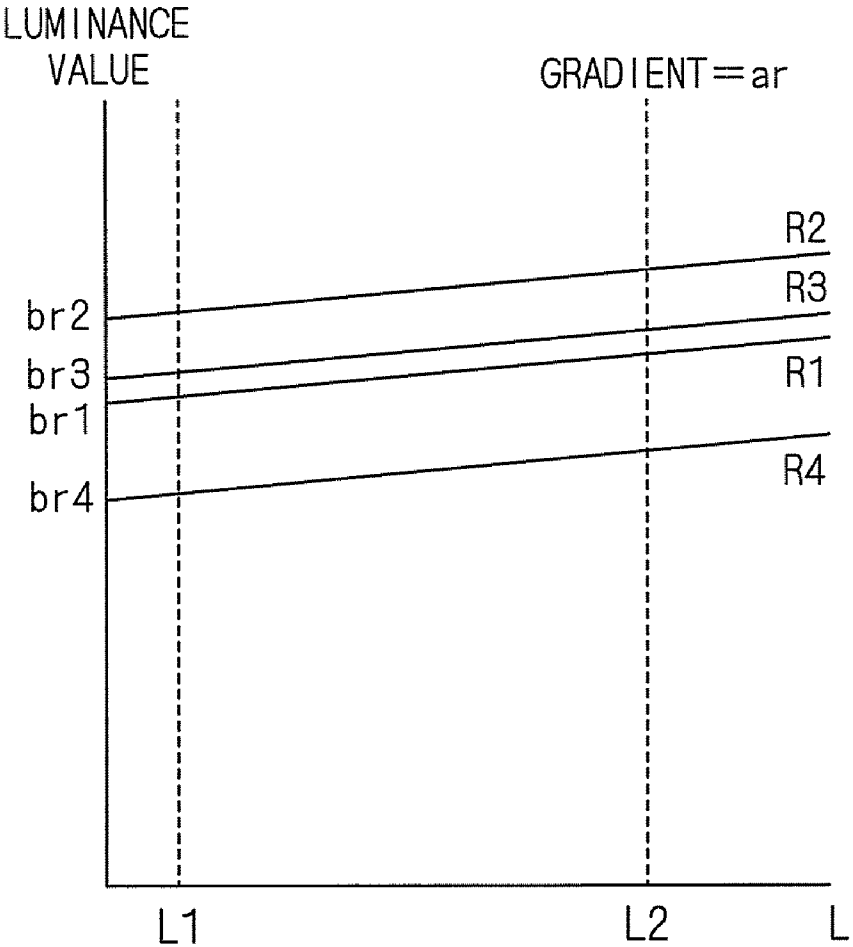
FIGS. 6A and 6B are diagrams showing a first example of a gradient of the luminance value in the longitudinal direction of the plasma tubes.
Figure 6A:
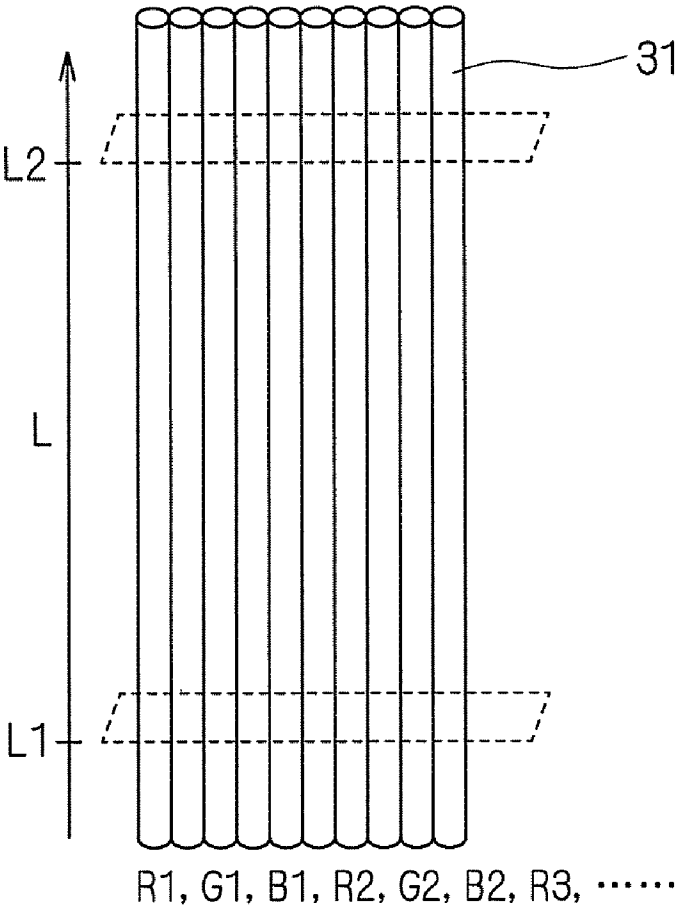

Since the luminance value of each plasma tube 31 varies because of the structure of the plasma tube 31, the luminance value varies in the parallel direction of the plasma tube array. On the other hand, in the longitudinal direction of each plasma tubes 31, there is a tendency that the luminance value monotonously increases depending on the relative position. The cause is considered that, in the process of manufacturing the plasma tube 31, since the tube is particularly thin and long, at the time of evacuating the tube and filling it with a gas, the state (cleanness or the like) of the discharge plane of the inner side of the plasma tubes 31, 31, . . . varies depending on distance from the evacuating port. Therefore, the gradient of the luminance value which shifts to increase little by little is expressed between emit light cells adjacent in the same plasma tube 31. FIGS. 6A and 6B are diagrams showing a first example of the gradient of the luminance value in the longitudinal direction of the plasma tubes 31, 31, . . . . FIG. 6A shows the plasma tube array in which the plurality of plasma tubes 31, 31, . . . of different luminance value by colors is arranged in parallel in the order of each color. FIG. 6B shows the gradient of the luminance value in the longitudinal direction of the plurality of plasma tubes 31, 31, . . . for red (R). The gradient of the luminance value in the longitudinal direction L of the plasma tubes 31, 31, . . . for red (R1) configuring the plasma tube array shown in FIG. 6A is approximated to a straight line with an intercept "br1" and a gradient "ar" using the longitudinal direction L as the horizontal axis and the luminance value as the vertical axis as shown in FIG. 6B. The gradient of the luminance value in the longitudinal direction L of the plasma tubes 31, 31, 31 for red (R2), red (R3), red (R) are also approximated to the straight lines having intercept "br2", "br3", "br4", respectively, and having almost the same gradient "ar" with that for red (R1).

In the example of FIGS. 6A and 6B, the luminance value in the longitudinal direction L of the plurality of plasma tubes 31, 31, . . . for red (R) arranged in parallel and configuring the plasma tube array changes linearly at almost the same gradient "ar" in any plasma tubes 31, 31, . . . , and shifts so as to gradually increase. The gradient of the luminance value of the plasma tubes 31 for red (R) is expressed by the gradient "ar" and the intercept "brx" of the straight lines. Each straight line indicative of the gradient of the luminance value of the plasma tubes 31, 31, . . . for red (R) has almost the same gradient "ar". Consequently, the gradient "ar" of the straight line can be calculated on the basis of the gradient of the luminance value of at least one plasma tube 31 for red (R), and the gradient "ar" of the straight line indicative of the gradient of the luminance value of all plasma tubes 31, 31, . . . for red (R) can be calculated. When each luminance value at the same relative position, for example, at the position L1 in the longitudinal direction L of all the plasma tubes 31, 31, . . . for red (R) is known, the intercept "brx" of each plasma tube 31 for red (R) can be calculated from the luminance value at the position L1 and the gradient "ar". The gradient of the luminance value of one plasma tube 31 for red (R) is calculated, for example, on the basis of the plurality of luminance value measured at the plurality of position in the longitudinal direction L of the plasma tubes 31, 31, . . . .

Figure 7B:
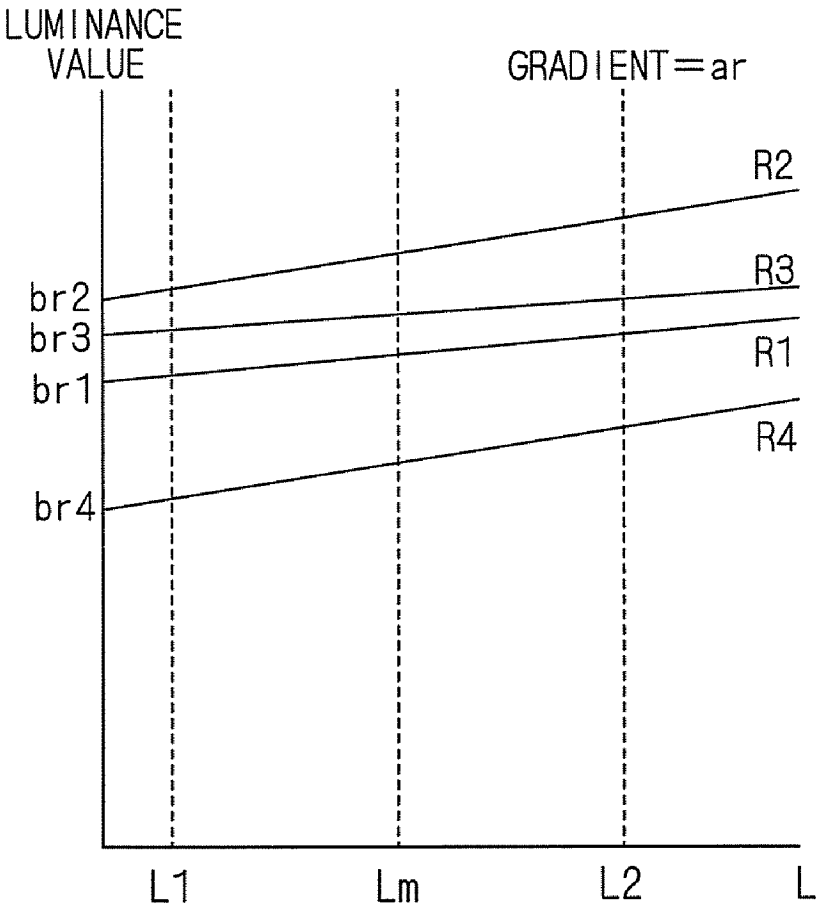
FIGS. 7A and 7B are diagrams showing a second example of the gradient of the luminance value in the longitudinal direction of the plasma tubes.
Figure 7A:
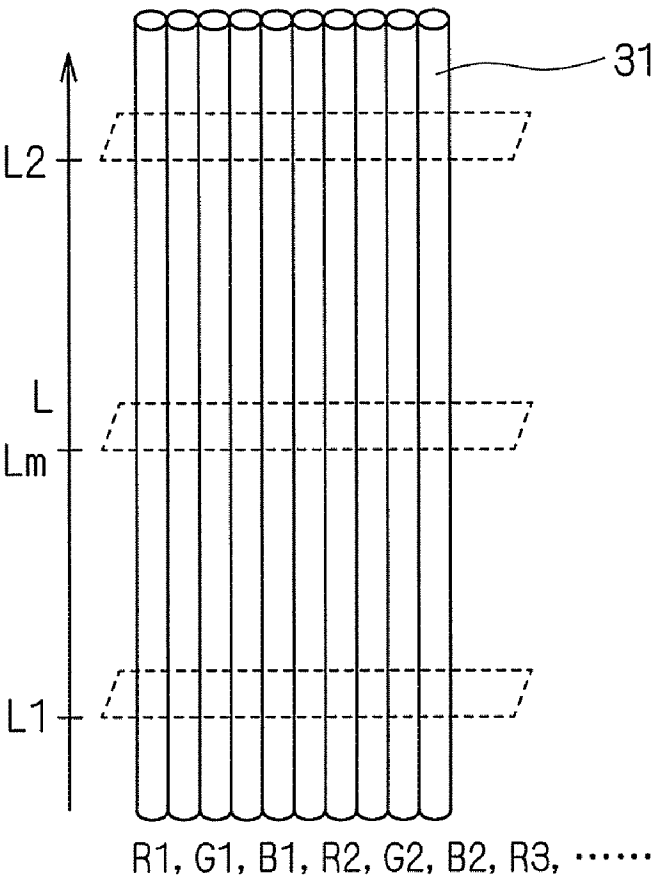

FIGS. 7A and 7B are diagrams showing a second example of the gradient of the luminance value in the longitudinal direction of the plasma tubes 31, 31, . . . . FIG. 7A shows the plasma tube array in which the plurality of plasma tubes 31, 31, . . . of different luminance value by colors is arranged in parallel in the order of each color. FIG. 7B shows the gradient of the luminance value in the longitudinal direction of the plurality of plasma tubes 31, 31, . . . for red (R). As in the gradient of the luminance value shown in FIGS. 6A and 6B, the plurality of plasma tubes 31, 31, . . . arranged in parallel and configuring the plasma tube array is expressed by the straight lines with almost the same gradient "ar" but with different intercepts "brx" in the longitudinal direction of the plasma tubes 31, 31, . . . . Even in the case where the gradient of the luminance value is constant, as shown in FIG. 7B, the gradient slightly varies depending on each plasma tube 31. In FIG. 7B, the gradient is shown exaggerated so that the gradient difference is clearly recognized. Since the gradient varies, the luminance difference among the plurality of plasma tubes 31, 31, . . . varies depending on the position in the longitudinal direction L of the plurality of plasma tubes 31, 31, . . . . That is, near both ends L1, L2 in the longitudinal direction of the plurality of plasma tubes 31, 31, . . . , the luminance difference is smaller or larger than that at an intermediate position Lm. Therefore, by obtaining the luminance value at almost the intermediate position Lm where the luminance difference has an average value as the luminance value of each plasma tube 31, even in the case where the plurality of plasma tubes 31, 31, . . . has different gradient of the luminance value, deviations in correction at both ends L1, L2 of the plasma tubes 31, 31, . . . can be suppressed and the luminance is properly corrected.

In the center of the field of view, variations in luminance (luminance unevenness) are visually recognized more strongly than those in the periphery. Depending on the degree of luminance unevenness visually recognized, the impression of the luminance unevenness of the entire field of view changes. In the case of forming a display film by joining the plasma tube arrays in the parallel direction, the intermediate position in the longitudinal direction of the plasma tubes 31, 31, . . . is the center of the field of view. Consequently, by obtaining the luminance value at almost the intermediate position as described above, an effect that the luminance unevenness is not easily recognized can be also expected.

The characteristic of gradient of the luminance value of the plasma tubes 31, 31, . . . described above is not limited only the plurality of plasma tubes 31, 31, . . . for red (R) but also similar in the plurality of plasma tubes 31, 31, . . . for green (G) and blue (B). Therefore, in the plasma tube array-type display device 1 according to the first embodiment, the luminance value at the plurality of position in the longitudinal direction L of at least one plasma tube 31 and the luminance value at the same relative position in the longitudinal direction of the plurality of plasma tubes 31, 31, . . . are obtained for each of the colors of R, G, B. The gradient of the luminance value is calculated from the obtained luminance value at the plurality of position in the longitudinal direction L of the one plasma tube 31, and the luminance value at the same relative position and the calculated gradient of the luminance value of each plasma tube obtained are stored.

Figure 8:
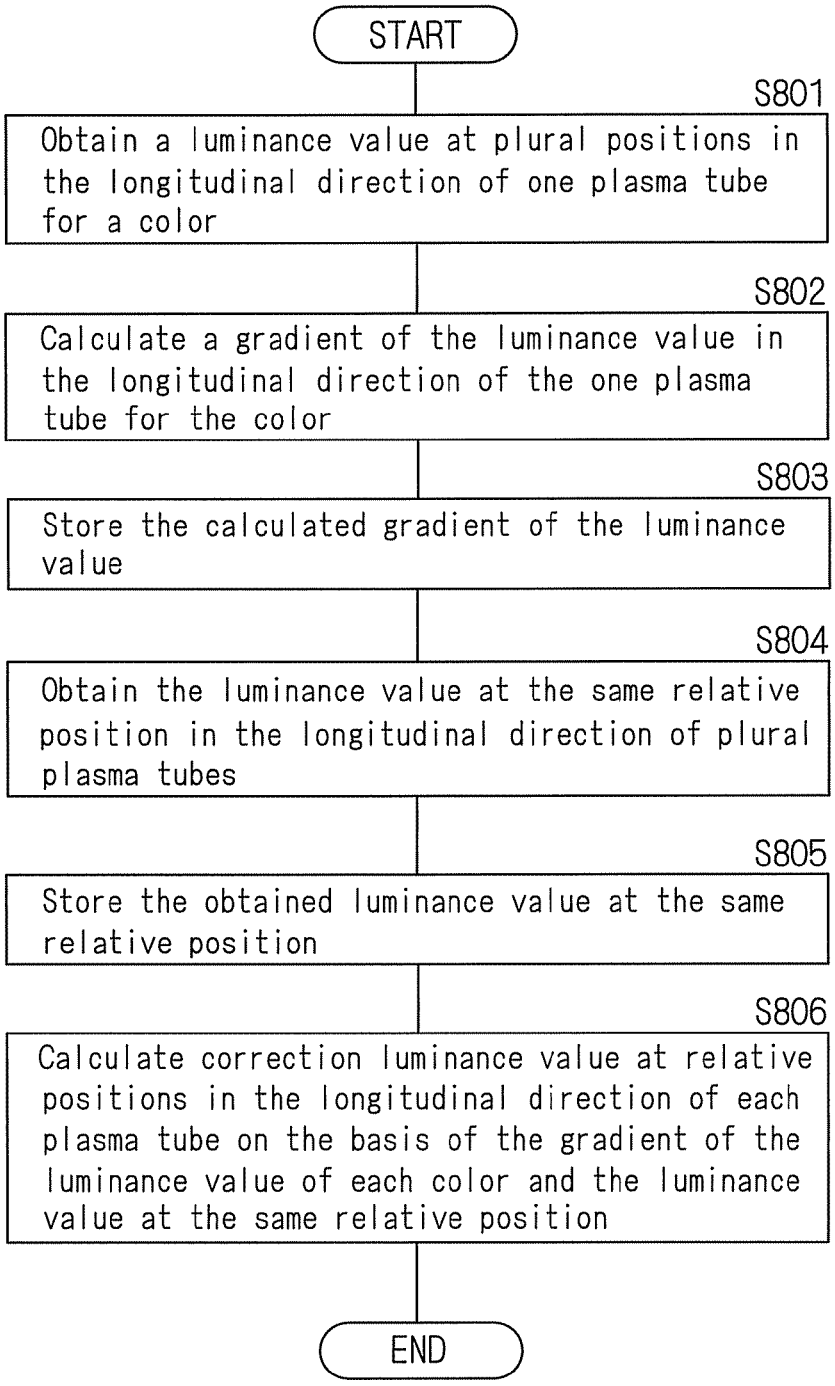
FIG. 8 is a flowchart showing a procedure of the controller of a drive unit of the plasma tube array-type display device according to the first embodiment of the present invention.

The operation of the plasma tube array-type display device 1 with the above-described configuration will now be described in detail on the basis of a flowchart. FIG. 8 is a flowchart showing the procedure of the controller 21 of the drive unit 2 of the plasma tube array-type display device 1 according to the first embodiment of the present invention.

As shown in FIG. 8, the controller 21 of the drive unit 2 obtains the luminance value for each of the colors of R, G, B at a plurality of positions in the longitudinal direction L of any one of the plurality of plasma tubes 31, 31, . . . for each of the colors of R, G, B configuring the plasma tube array (step S801). The controller 21 calculates the gradient of the luminance value in the longitudinal direction of the one plasma tube 31 on the basis of luminance values in the plurality of positions in the longitudinal direction of the one plasma tube 31 obtained by each color (step S802) and stores it in the memory 222 (step S803). The gradient of the luminance value can be calculated as intercept information and gradient information of the straight line obtained by performing first-order approximation of the gradient of the luminance value at relative position in the longitudinal direction of the plasma tubes 31, 31, . . . .

The controller 21 obtains luminance value at the same relative position in the longitudinal direction L of the plurality of plasma tubes 31, 31, . . . for each color configuring the plasma tube array, for example, at the position Lm shown in FIG. 7B on the basis of the calculated gradient of the luminance value in the longitudinal direction L of the one plasma tube 31 for each of the R, G, B colors (step S804) and stores it in the memory 222 (step S805). Not only each luminance value but also information for identifying the plasma tubes 31, 31, . . . and information for the relative position in the longitudinal direction L of the plasma tubes 31, 31, . . . are also stored in association with the luminance value.

On the basis of the gradient of the luminance value of each color and the luminance value at the same relative position of each plasma tube 31 stored in the memory 222, the controller 21 calculates a correction luminance value at each relative position in the longitudinal direction of each plasma tube 31 configuring the plasma tube array (step S806). Concretely, on the basis of the gradient of the luminance value and the luminance value at the same relative position of each plasma tube 31, the controller 21 calculates the luminance value at relative position in the longitudinal direction of all plasma tubes 31, 31, . . . configuring the plasma tube array, and using the calculated luminance value, corrects image data of all pixels stored in the memory 222, that is, the luminance value of all pixels formed by all plasma tubes 31, 31, . . . configuring the plasma tube array.

As described above, according to the first embodiment, the plurality of plasma tubes 31, 31, . . . arranged in parallel and configuring the plasma tube array has similar gradient of the luminance value in the longitudinal direction of the plasma tubes 31, 31, . . . . By using the gradient of the luminance value of at least one plasma tube 31 and the luminance value at the same relative position of all of the plasma tubes 31, 31, . . . configuring the plasma tube array, the gradient of the luminance values of all of the plasma tubes 31, 31, . . . can be grasped, and variations in luminance values of the plasma tube array can be reduced. Therefore, without requiring a large memory and a high-speed computing circuit, on the basis of the gradient of the luminance value of at least one plasma tube 31 and the luminance value at the same relative position of all plasma tubes 31, 31, . . . only, the luminance value of all pixels in all of the plasma tubes 31, 31, . . . configuring the plasma tube array can be corrected.

In particular, by obtaining luminance value at the intermediate position in the longitudinal direction of the plurality of plasma tubes 31, 31, . . . where the luminance has an average value as the luminance value of each plasma tubes 31, even in the case where the plurality of plasma tubes 31, 31, . . . has different gradient of the luminance value, deviations in correction at the position near both ends of the plasma tubes 31, 31, . . . can be suppressed and the luminance is properly corrected.

In the first embodiment, the luminance value is obtained color by color with respect to all plasma tubes 31, 31, . . . for all of the three colors of R, G, B. Alternatively, only the luminance value of the plasma tubes 31, 31, . . . for green (G) whose luminance difference can be easily visually recognized may be obtained for the reason that a memory amount required for correction can be reduced.

Second Embodiment

Since the hardware configuration of the plasma tube array-type display device 1 according to the second embodiment is similar to that of the first embodiment, the same reference symbols are appended to the similar components, and the detailed description will be omitted in this section. In addition, the functional configuration of the controller 21 of the drive unit 2 of the plasma tube array-type display device 1 according to the second embodiment is similar to that of the first embodiment. Therefore, the same reference symbols are appended to the similar components, and the detailed description will be omitted in this section.

Figure 9B:
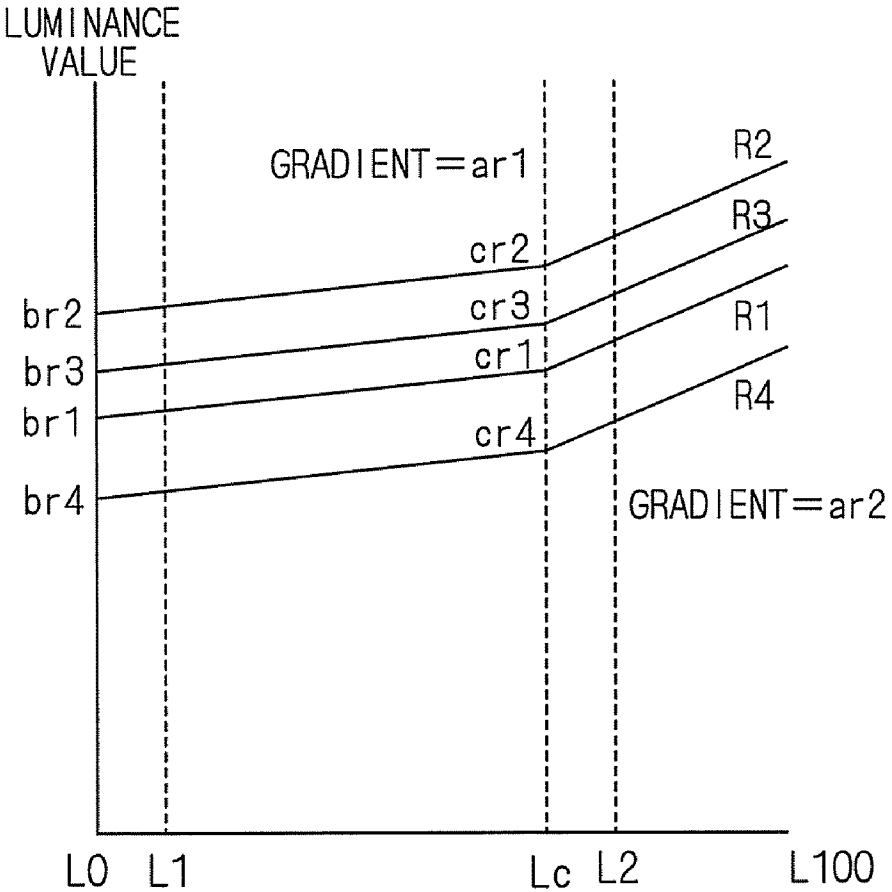
FIGS. 9A and 9B are diagrams showing a third example of the gradient of the luminance value in the longitudinal direction of the plasma tubes.
Figure 9A:
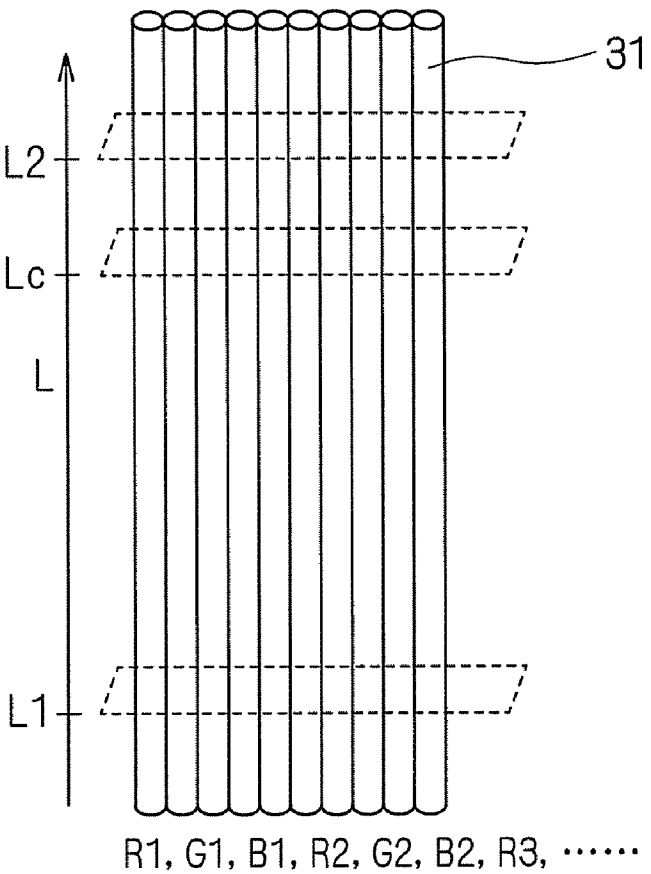

The second embodiment is different from the first embodiment in that in the case where the gradient of the luminance value is calculated so as to be different with the boundary at a predetermined position in the longitudinal direction of the plasma tubes 31, 31, . . . , the controller 21 of the drive unit 2 obtains the luminance value at the same relative position in the longitudinal direction of the plurality of plasma tubes 31, 31, . . . by every gradient. FIGS. 9A and 9B are diagrams showing a third example of the gradient of the luminance value in the longitudinal direction of the plasma tubes 31, 31, . . . . FIG. 9A shows the plasma tube array in which the plurality of plasma tubes 31, 31, . . . having different luminance values color by color are arranged in parallel in order of colors. FIG. 9B shows the gradient of the luminance value in the longitudinal direction of the plurality of plasma tubes 31, 31, . . . for red (R).

As shown in FIG. 9B, the gradient of the luminance value in the longitudinal direction of the plurality of plasma tubes 31, 31, . . . arranged in parallel and configuring the plasma tube array varies with the boundary at a predetermined position Lc in the longitudinal direction L of the plasma tubes 31, 31, . . . . Concretely, from one end L0 in the longitudinal direction L of the plasma tubes 31, 31, . . . to the predetermined position Lc, the gradient of the luminance value indicated by first straight lines comprises different intercepts "brx" and an almost same gradient "ar1", and, from the predetermined position Lc to the other end L100, the gradient of the luminance value indicated by second straight lines comprises different intercepts "brx" and an almost same gradient "ar2" which is different from that of the first straight lines. That is, the gradient of the luminance degree is expressed by two straight lines with gradients "ar1" and "ar2" different between the one end L0 side and the other end L100 side from the predetermined position Lc relative to the position in the longitudinal direction L of the plasma tubes 31, 31, . . . , in the longitudinal direction L of the plasma tubes 31. Therefore, by obtaining luminance value at the same relative position in the longitudinal direction of the plurality of plasma tubes 31, 31, . . . by every gradient of the luminance value, that is, by obtaining the luminance value of all of the plurality of plasma tubes 31, 31, . . . at two same relative positions of a first same relative position L1 between one end L0 to the predetermined position Lc where the gradient changes and a second same relative position L2 from the predetermined position Lc where the gradient changes to the other end L100, proper correction is possible in accordance with variations in gradients.

Figure 10:
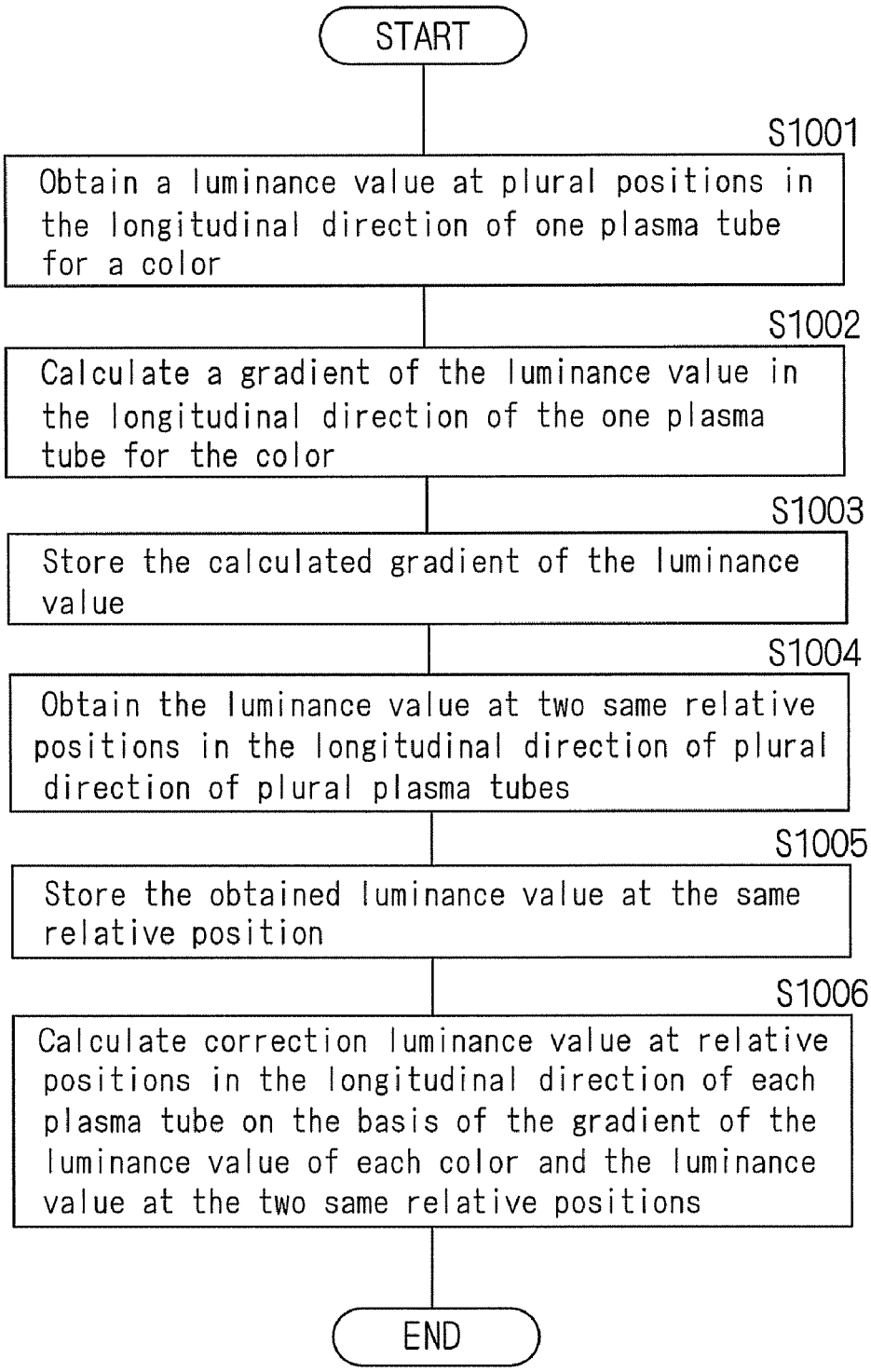
FIG. 10 is a flowchart showing a procedure of the controller of the drive unit of the plasma tube array-type display device according to a second embodiment of the present invention.

FIG. 10 is a flowchart showing the procedure of the controller 21 of the drive unit 2 of the plasma tube array-type display device 1 according to the second embodiment of the present invention. As shown in FIG. 10, the controller 21 of the drive unit 2 obtains the luminance value at the plurality of position in the longitudinal direction L of any one of the plurality of plasma tubes 31, 31, . . . for the colors configuring the plasma tube array with respect to each of the R, G, B colors (step S1001). The controller 21 calculates the gradient of the luminance value in the longitudinal direction of one plasma tube 31 on the basis of the luminance value at the plurality of position in the longitudinal direction of the one plasma tube 31 obtained color by color (step S1002) and stores it in the memory 222 (step S1003). In the second embodiment, as a combination of two straight lines with different gradients, intercept information and gradient information are calculated.

The controller 21 obtains the luminance value at the two same relative positions: the same relative position L1 on one end L0 side and the same relative position L2 on the other end L100 side shown in FIG. 9B with respect to the plurality of plasma tubes 31, 31, . . . for the colors configuring the plasma tube array on the basis of the calculated gradient of the luminance value in the longitudinal direction L of one plasma tube 31 of each of the R, G, and B colors, for example, the gradient of the luminance value with the gradient "ar1", "ar2", different between the one end L0 side and the other end L100 side from the predetermined position Lc (step S1004) and stores it in the memory 222 (step S1005).

The controller 21 calculates correction luminance value at each relative position in the longitudinal direction of each plasma tube configuring the plasma tube array on the basis of the gradient of the luminance value color by color and the luminance value at the two same relative positions of each of the plasma tube 31 stored in the memory 222 (step S1006). Concretely, the luminance value at each position in the longitudinal direction of all of the plasma tubes configuring the plasma tube array are calculated on the basis of the gradient of the two luminance values and the luminance value at the two same relative positions of each plasma tube 31 stored in the memory 222. Using the calculated luminance values, the image data of all pixels stored in the memory 222, that is, the luminance values of all pixels formed by all of the plasma tubes 31, 31, . . . configuring the plasma tube array are corrected.

As described above, according to the second embodiment, in the case where the plurality of plasma tubes 31, 31, . . . arranged in parallel and configuring the plasma tube array has different gradient of the luminance value with the boundary at a predetermined position in the longitudinal direction of the plasma tubes 31, 31, . . . , by obtaining the luminance values at the same relative positions in the longitudinal direction of the plurality of plasma tubes 31, 31, . . . for each gradient, the luminance value can be properly corrected according to variations in gradients.

Third Embodiment

Figure 11:
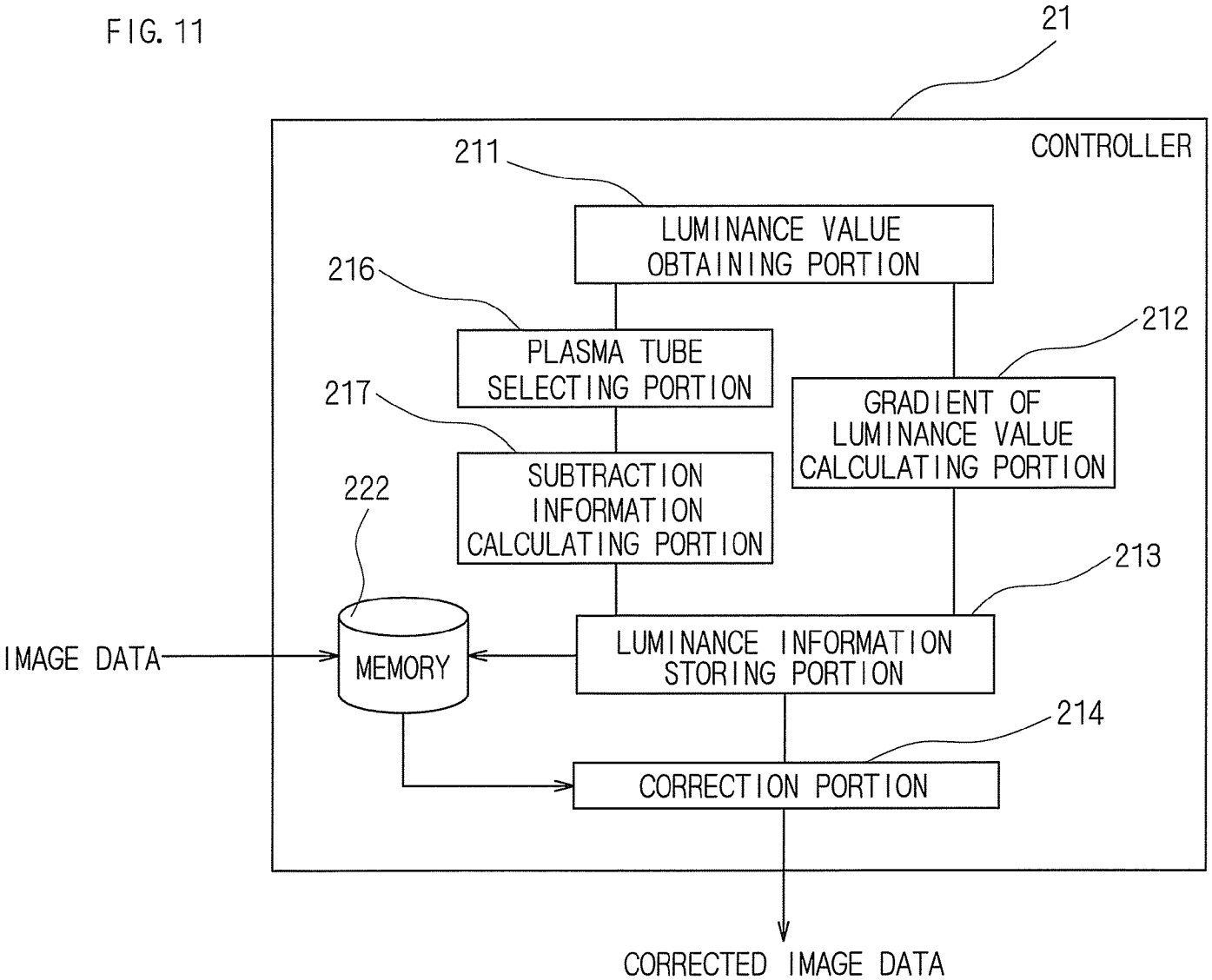
FIG. 11 is a block diagram showing a functional configuration of the controller of the drive unit of the plasma tube array-type display device according to a third embodiment of the present invention.

Since the hardware configuration of the plasma tube array-type display device 1 according to the third embodiment is similar to that of the first embodiment, the same reference symbols are appended to the similar components, and the detailed description will be omitted in this section. FIG. 11 is a block diagram showing a functional configuration of the controller 21 of the drive unit 2 of the plasma tube array-type display device 1 according to the third embodiment of the present invention. Since the functional configuration of the controller 21 of the drive unit 2 of the plasma tube array-type display device 1 according to the third embodiment is similar to that of the first embodiment as shown in FIG. 11, the same reference symbols are appended to the similar components, and the detailed description will be omitted in this section.

In the third embodiment, the controller 21 of the drive unit 2 has: plasma tube selecting portion 216 for selecting a plasma tube having a luminance value by predetermined value higher than that of the adjacent plasma tube of the same color in the same relative position; and subtraction information calculating portion 217 for calculating subtraction information for subtracting the luminance value of every selected plasma tube at a predetermined ratio on the basis of the luminance value of the selected plasma tubes and the luminance value of the plasma tube of the same color arranged within a predetermined range from the plasma tube. The luminance information storing portion 213 stores the luminance values at the same relative position of the selected plasma tubes, the subtraction information, and the calculated gradient of the luminance value in the memory 222.

Figure 12:
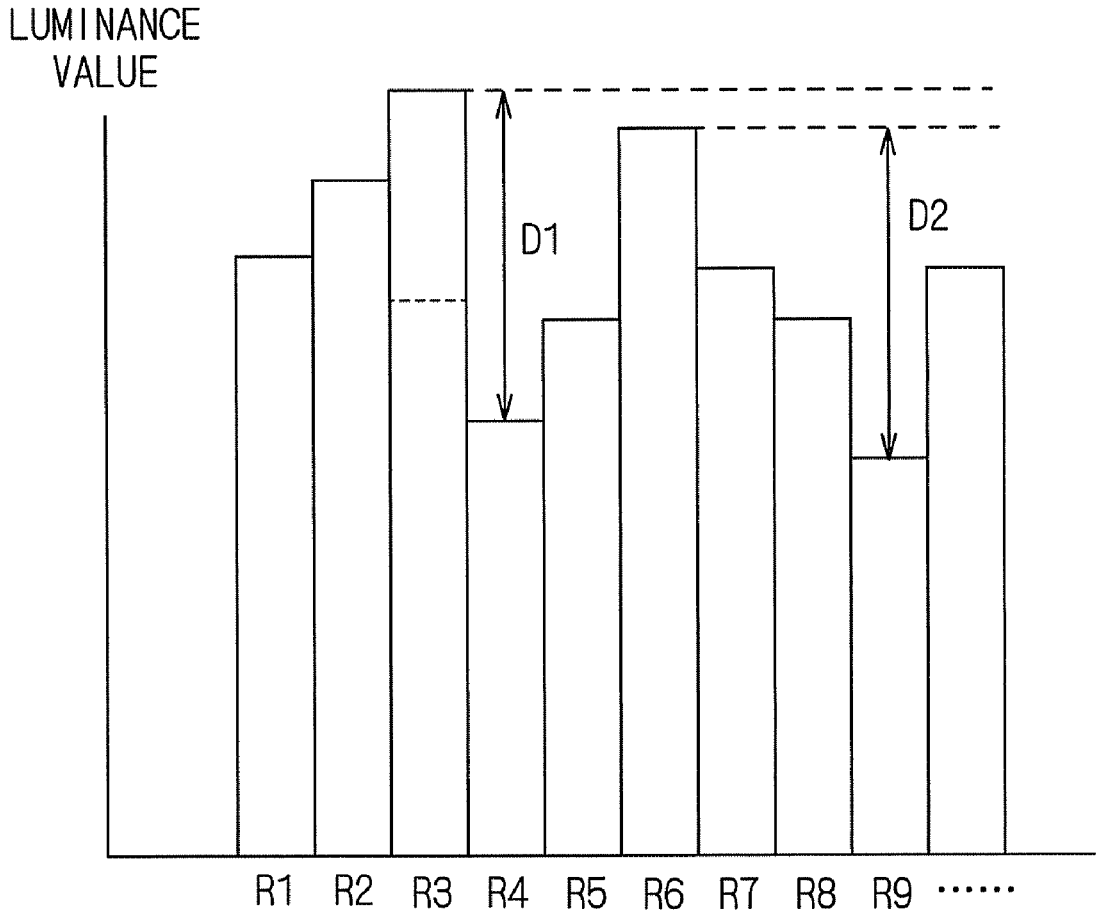
FIG. 12 is a diagram showing an example of a criterion for selecting a plasma tube in a position where the luminance difference is large from a plurality of plasma tubes for red.

FIG. 12 is a diagram showing an example of a criterion for selecting a plasma tube in a position where the luminance difference is large from the plurality of plasma tubes 31, 31, . . . for red (R). FIG. 12 shows the luminance values at the same relative position in the longitudinal direction of the plurality of plasma tubes 31, 31, . . . for red (R) arranged in parallel on the plasma tube array, in the arranged order. In FIG. 12, for example, the plasma tube 31 for red (R3) and the plasma tube 31 for red (R4) are adjacent as plasma tubes for red (R), but on the plasma tube array, the plasma tube for green (G) and the plasma tube for blue (B) are arranged between them. In reality, there is an interval of two plasma tubes between the plasma tubes 31, 31, . . . for red (R3), red (R4). Even if luminance difference D1 between the plasma tubes 31, 31, . . . for red (R3), red (R4) and luminance difference D2 between the plasma tubes 31, 31, . . . for red (R6), red (R9) are the same, due to so-called mach effect, it is visually recognized that the luminance difference D1 between the plasma tubes 31, 31, . . . in shorter distance is larger than the luminance difference D2 between the plasma tubes 31, 31, . . . in longer distance.

Specifically, the luminance difference between the plasma tubes 31, 31, . . . in far places is not so easily recognized as variations in luminance values and as color unevenness among pixels each configured as a unit of plasma tubes 31, 31, . . . for three colors of R, G, B. Therefore, by correcting only the luminance value of the plasma tubes 31, 31, . . . in near places that the luminance difference can be easily recognized, the memory amount required for correction can be reduced, and color unevenness can be effectively suppressed.

Concretely, as shown in FIG. 12, the plasma tubes 31, 31, . . . for red (R3), red (R4) having luminance difference D1 with the adjacent plasma tubes 31, 31, . . . of the same color exceeding a predetermined threshold are selected from each luminance value at the same relative position in the longitudinal direction of the plurality of plasma tubes 31, 31, . . . for the same color, red (R) arranged in parallel in the plasma tube array, and the plasma tube 31 for red (R3) with higher luminance value than the plasma tube 31 for red (R4) is selected. Since only the selected plasma tube 31 for red (R3) is corrected, only the luminance value of the plasma tube 31 for red (R3) is stored in the memory 222. However, the luminance values of the plasma tubes 31, 31, . . . for red (R2), red (R4), and the like as objects of luminance difference comparison are not stored in the memory 222, so that the degree of the luminance value correction cannot be determined. Consequently, the subtraction information for subtracting the luminance value at a predetermined ratio is calculated for each selected plasma tube 31 on the basis of the luminance value of the selected plasma tube 31 for red (R3) and the luminance values of the plasma tubes 31, 31, . . . of the same color in a predetermined range from the selected plasma tube 31, and stored it together with the luminance value of the plasma tube 31 for red (R3). For example, as shown in FIG. 12, the subtraction information of subtracting the luminance value of the plasma tube 31 for red (R3) at a predetermined ratio is stored so that the luminance value of the plasma tube 31 for red (R3) becomes an intermediate value between the luminance value of the plasma tube 31 for red (R2) and the luminance value of the plasma tube 31 for red (R4).

Figure 13:
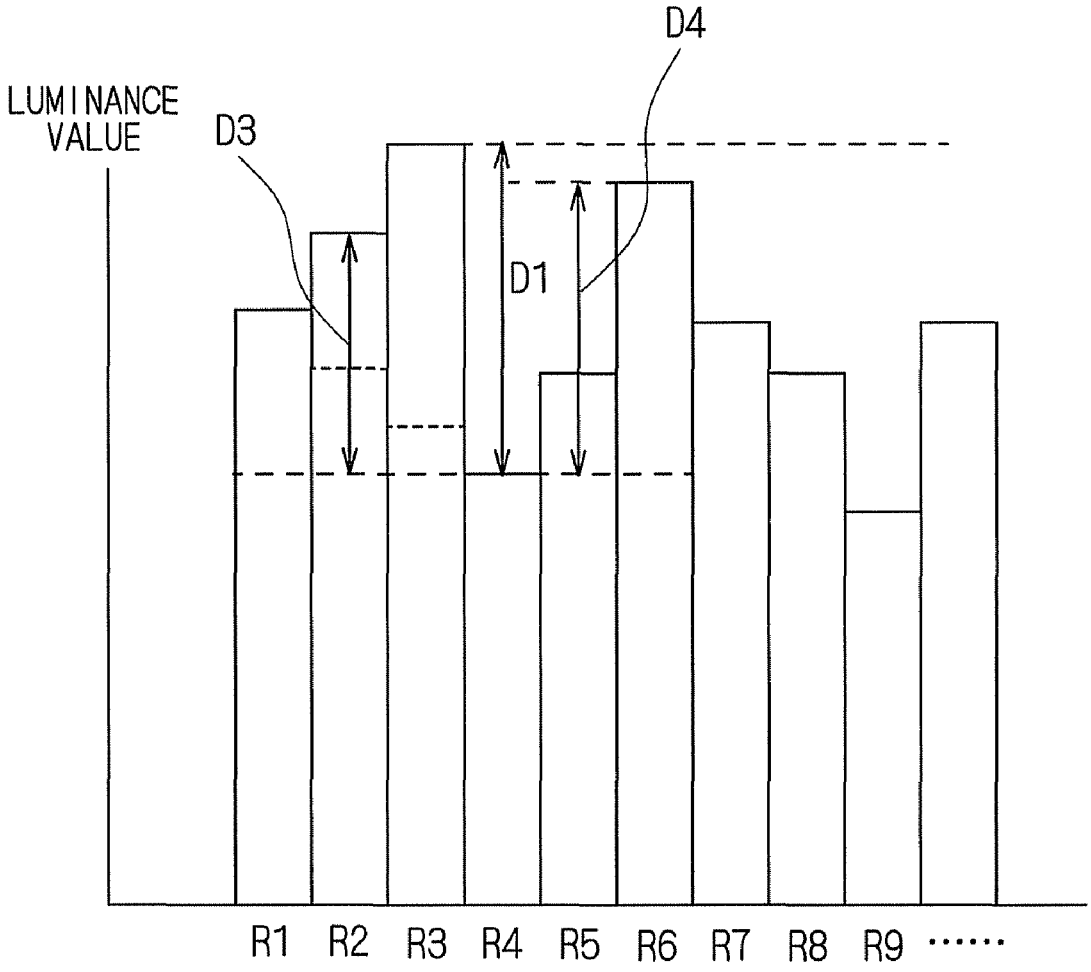
FIG. 13 is a diagram showing another example of the criterion for selecting a plasma tube in a position where the luminance difference is large from a plurality of plasma tubes for red.

The subtraction information may be calculated on the basis of not only the luminance values of the adjacent plasma tubes 31, 31, . . . but also the luminance values of the plasma tubes 31, 31, . . . of the same color in a range of a predetermined number of (such as two, three, or the like) plasma tubes apart from the selected plasma tube 31. By widening the range, variations in luminance values can be reduced. Similarly, to widen the range, also at the time of selecting a plasma tube 31, not only the luminance difference between the adjacent plasma tubes 31, 31, . . . of the same color as described above but also the luminance differences of three or more plasma tubes 31, 31, . . . may be compared. FIG. 13 is a diagram showing another example of a criterion for selecting a plasma tube 31 in a position where the luminance difference is large from a plurality of plasma tubes 31, 31, . . . for red (R). FIG. 13 shows the same luminance value example as that of FIG. 12.

As shown in FIG. 13, in the case of comparing the luminance difference with the plasma tubes 31, 31, . . . two tubes apart, not only the luminance difference D1 between the plasma tubes 31, 31, . . . for red (R3), red (R4) but also a luminance difference D3 between the plasma tubes 31, 31 for red (R2), red (R4), and a luminance difference D4 between the plasma tubes 31, 31 for red (R4), red (R6) exceed a predetermined threshold. Consequently, the luminance values of the plasma tubes 31, 31 for red (R2), red (R6) are subtracted. The luminance values of the plasma tubes 31, 31 for red (R2), red (R3) are subtracted at the same time. The luminance value of the plasma tubes 31, 31 for red (R2) is subtracted so as to be a luminance value of the plasma tubes 31 subtracted only the luminance value of ⅓ of the luminance difference between the plasma tubes 31, 31 for red (R1), red (R4) from the luminance value of the plasma tube 31 for red (R1). The luminance value of the plasma tube 31 for red (R3) is subtracted so as to be a luminance value subtracted only the luminance value of ⅔ of the luminance difference between the plasma tubes 31, 31 for red (R1), red (R4) from the luminance value of the plasma tube 31 for red (R1). Since the luminance value changes at the same degree in red (R1) to red (R4), variations in luminance values cannot be easily visually recognized. By making the luminance difference between the plasma tubes 31, 31 for red (R3), red (R4) smaller than that between the plasma tubes 31, 31 for red (R2), red (R3), the luminance difference between the plasma tubes 31, 31, . . . in near positions can be made smaller than that between the plasma tubes 31, 31, . . . in far positions. By the above-described mach effect, variations in luminance values are not easily visually recognized as color unevenness.

Figure 14:
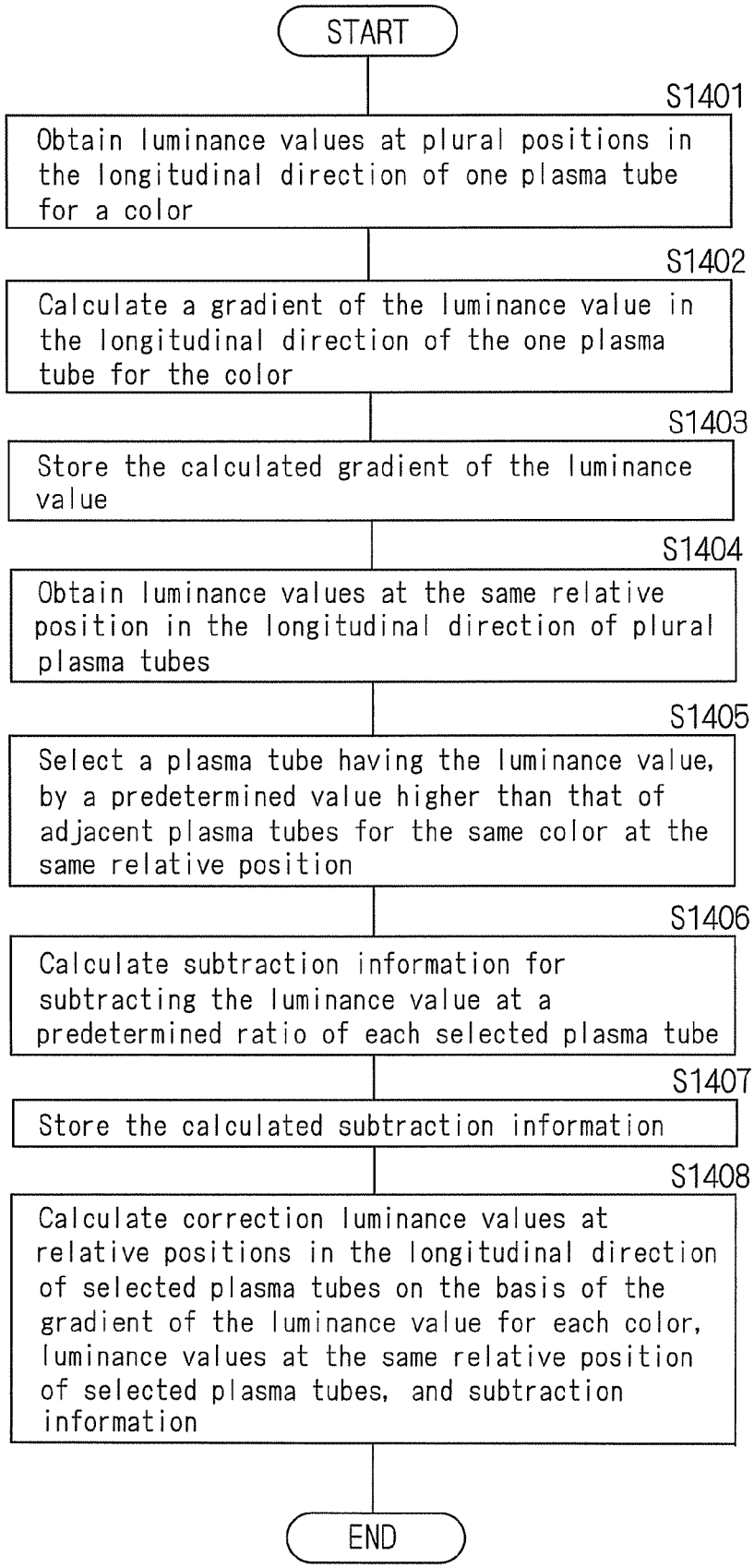
FIG. 14 is a flowchart showing a procedure of the controller of the drive unit of the plasma tube array-type display device according to the third embodiment of the present invention.

FIG. 14 is a flowchart showing the procedure of the controller 21 of the drive unit 2 of the plasma tube array-type display device 1 according to the third embodiment of the present invention. As shown in FIG. 14, the controller 21 of the drive unit 2 obtains the luminance values at the plurality of positions in the longitudinal direction L of any one of the plurality of plasma tubes 31, 31, . . . for the colors configuring the plasma tube array with respect to each of the R, G, B colors (step S1401). The controller 21 calculates the gradient of the luminance value in the longitudinal direction of one plasma tube 31 for the colors on the basis of the luminance value at the plurality of positions in the longitudinal direction of the one plasma tube 31 obtained color by color (step S1402) and stores it in the memory 222 (step S1403).

The controller 21 obtains the luminance values at the same relative position in the longitudinal direction L of the plurality of plasma tubes 31, 31, . . . for the colors configuring the plasma tube array on the basis of the calculated gradient of the luminance value in the longitudinal direction L of the one plasma tube 31 for colors with respect to each of the R, G, B colors (step S1404).

The controller 21 selects the plasma tube 31 having the luminance value, by a predetermined value higher than the luminance values of the adjacent plasma tubes 31, 31, . . . for the same color at the same relative position with respect to each of the R, G, B colors (step S1405). The controller 21 calculates the subtraction information of subtracting the luminance value at a predetermined ratio of each of the selected plasma tubes 31, 31, . . . on the basis of the luminance value of the selected plasma tube 31 and the luminance values of the plasma tubes 31, 31, . . . of the same color in a predetermined range from the selected plasma tube 31 (step S1406) and stores it in the memory 222 (step S1407).

The controller 21 respectively calculates correction luminance values at relative positions at the longitudinal direction of each selected plasma tube 31 of all of the plasma tubes 31, 31, . . . configuring the plasma tube array on the basis of the gradient of the luminance value color by color, the luminance values at the same relative position of each selected plasma tube 31, and subtraction information stored in the memory 222 (step S1408). Concretely, the luminance values at each position in the longitudinal direction of the selected plasma tubes 31, 31, . . . of the plasma tubes 31, 31, . . . configuring the plasma tube array are calculated on the basis of the gradient of the luminance values and the luminance value at the same relative position of each selected plasma tube 31. The calculated luminance value is subtracted at a predetermined ratio in accordance with the subtraction information. Using the subtracted luminance values, the luminance values of pixels formed by the selected plasma tubes 31, 31, . . . stored in the memory 222 are corrected.

Figure 15:
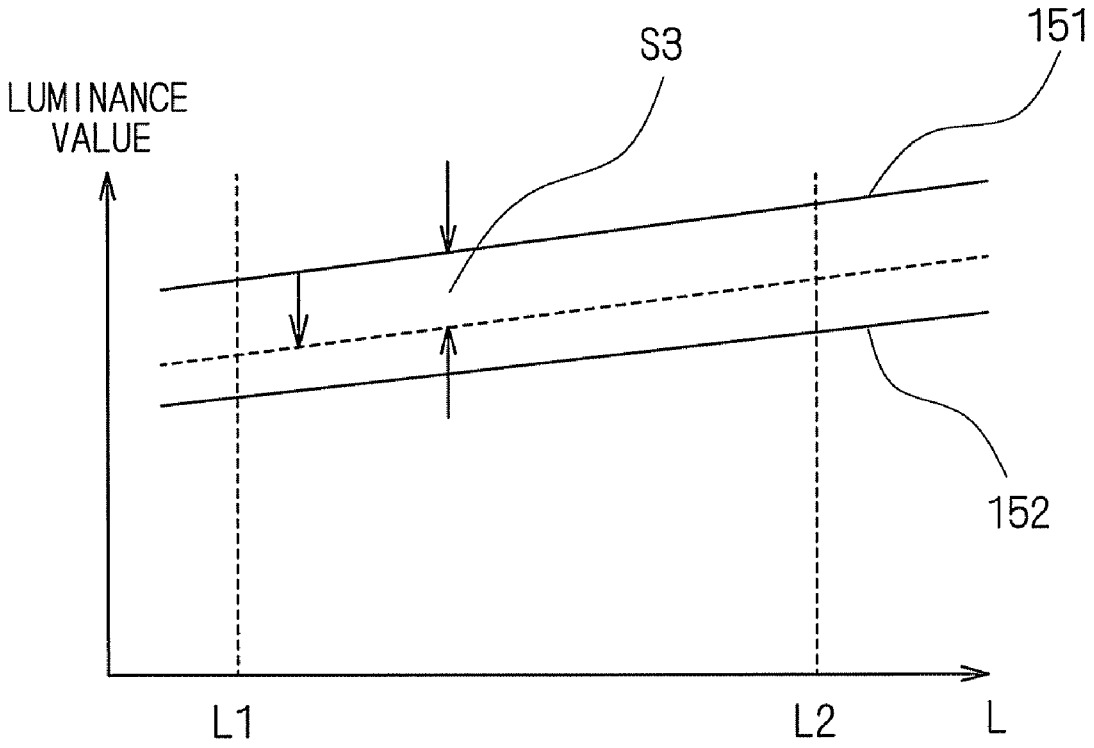
FIG. 15 is a diagram showing an example of subtraction information of a plasma tube for red (R3)

Procedure of generating corrected image data from actually input image data of one of pixels formed by the selected plasma tube 31 will be described. FIG. 15 is a diagram showing an example of subtraction information of the plasma tube 31 for red (R3) shown in FIG. 12. In FIG. 15, 151 denotes luminance value change at a relative position in the longitudinal direction of the plasma tube 31 for red (R3), and 152 denotes luminance value change at the relative position in the longitudinal direction of the plasma tube 31 for red (R4). As shown in FIG. 15, the plasma tube 31 for red (R3) is corrected so as to decrease the luminance value with respect to the adjacent plasma tube 31 for red (R4), so that subtraction information S3 is calculated by the subtraction information calculating portion 217. FIG. 15 shows the case of using the same subtraction information S3 for all pixels of the plasma tube 31 for red (R3) at any relative positions in the longitudinal direction L of the plasma tubes 31, 31, . . . .

Figure 16:
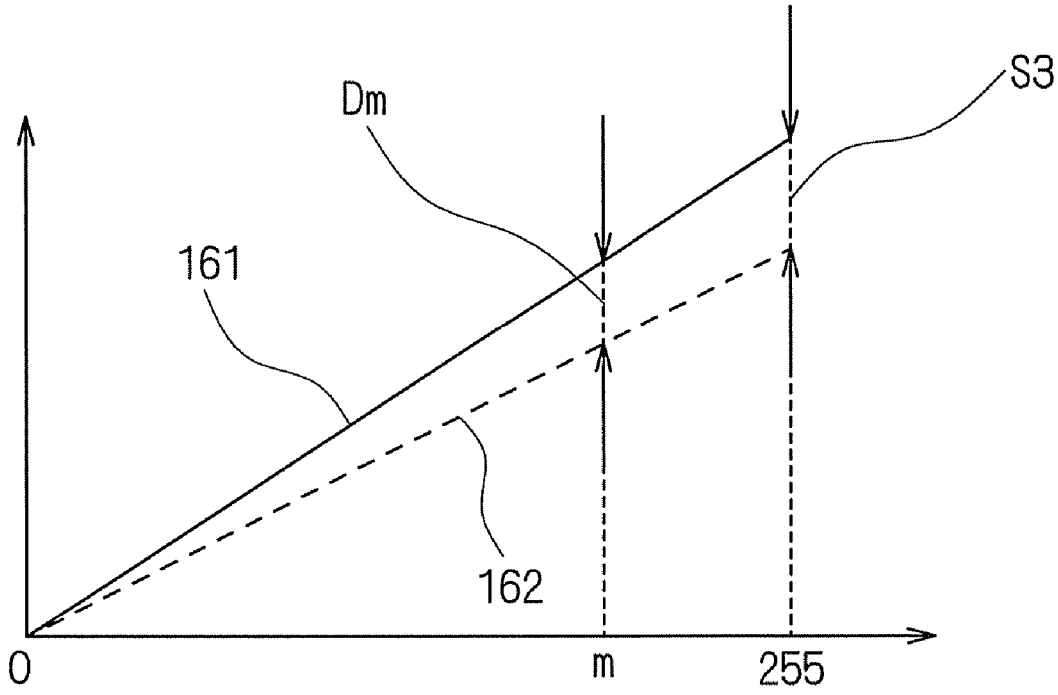
FIG. 16 is a diagram showing an example of luminance value correction on the plasma tube for red (R3).

Using the subtraction information S3, the correcting portion 214 corrects the luminance value on the input image data. FIG. 16 is a diagram showing an example of the luminance value correction on the plasma tube 31 for red (R3) shown in FIG. 12. FIG. 16 shows pixel data (eight bits and full color) from 0 (zero) to 255 as input image data.

As shown in FIG. 16, in the case where the luminance value of input image data is "m", a new correction luminance value Dm is calculated for the subtraction information S3. The correction luminance value Dm varies from 0 (zero) to S3 depending on the luminance value of the input image data. The correction luminance value Dm is calculated by referring to the correction luminance value Dm on the basis of the subtraction information S3 and the luminance value "m" of the input image data by using, for example, a general lookup table. Since the subtraction information S3 and the luminance value "m" are both limited integral values, they can be easily calculated by using a lookup table.

By the process shown in FIG. 16, the correcting portion 214 calculates corrected image data 162 of the plasma tube 31 for red (R3) by subtracting the correction luminance value Dm from the input image data 161 of the plasma tube 31 for red (R3). The correcting process in the correcting portion 214 is not limited to the above-described process. For example, the correction luminance value may be calculated by calculating a gradient S3/256 depending on the luminance value of the subtraction information S3 as a gradient correction coefficient and performing multiplication as follows.

$$\text{Corrected image data} = \text{input image data} \times (S3/256) \times m$$

As described above, according to the third embodiment, as in the first and second embodiments, the gradient of the luminance value of the plasma tubes 31, 31, . . . obtained can be grasped only from the gradient of the luminance value of at least one plasma tube 31 and the luminance values at the same relative position of the plasma tubes 31, 31, . . . obtained. Moreover, by selecting a plasma tube 31 having a luminance value by a predetermined luminance higher than that of the adjacent plasma tubes 31, 31, . . . of the same color at the same relative position and storing only the luminance value of the selected plasma tube 31 together with the subtraction information for subtracting the luminance value at a predetermined ratio, without storing all of the luminance values at the same relative position in the longitudinal direction of the plurality of plasma tubes 31, 31, . . . obtained, the correction luminance values at each relative positions in the longitudinal direction of the selected plasma tubes 31, 31, . . . can be calculated. Therefore, by correcting only the luminance values of the plasma tubes 31, 31, . . . in positions where the luminance difference is easily visually recognized, the memory amount required for correction can be reduced and occurrence of color unevenness and the like can be effectively reduced.

Obviously, various modification, replacements, and the like are possible within the scope of the gist of the present invention. For example, even in the case where the gradient of the luminance value of the plasma tubes 31, 31, . . . does not lie on an almost straight line, the tendencies of the gradient of each plasma tube 31 are almost the same. Therefore, it is also possible to preliminarily measure a first coefficient indicative of a change in the luminance characteristic along the longitudinal direction of at least one plasma tube and a second coefficient indicative of the difference of luminance characteristic of display lines along at least a pair of display electrodes of all plasma tubes, calculate a luminance correction coefficient depending on the position of each display cell on the basis of the first and second coefficients measured, and correct luminance data to be displayed by using the calculated luminance correction coefficient. By measuring the first and second coefficients in advance, even in the case where the gradient of the luminance value of the plasma tube 31 do not lie almost on the straight line, since the tendencies of the gradient of the plasma tubes 31 are almost the same, the luminance values of the plasma tubes 31, 31, . . . can be properly corrected.

What is claimed is:

1. A plasma tube array-type display device comprising:

a plurality of plasma tubes independent of one another and filled with a discharge gas;

an address electrode along the longitudinal direction of each plasma tube; and a plurality of display electrode pairs extending in the direction crossing all of the plasma tubes so as to form display lines of discharge cells in intersecting portions with the address electrodes, wherein the plasma tube array-type display device comprises:

a first memory for storing a first coefficient representing a gradient of a luminance value along the longitudinal direction of at least one of the plurality of plasma tubes;

a second memory for storing second coefficients representing a difference of the luminance value of each of the discharge cells at the same relative position in the longitudinal direction of the plurality of plasma tubes; and a controller for calculating a correction coefficient for a luminance value at each discharge cell in the longitudinal direction of each of the plurality of plasma tubes on the basis of the first coefficient and the second coefficients.

2. The plasma tube array-type display device according to claim 1, wherein the plurality of plasma tubes comprises plasma tubes for three colors of red, green, and blue, and the first memory stores the three kinds of first coefficients respectively representing the gradient of the luminance value of at least one plasma tube for each color.

3. The plasma tube array-type display device according to claim 1, wherein the plurality of plasma tubes comprises plasma tubes for three colors of red, green, and blue, and the first memory stores the first coefficient representing the gradient of the luminance value of at least one plasma tube for green.

* * * * *